US005562879A

United States Patent [19]

Coble

[11] Patent Number: 5,562,879

[45] Date of Patent: Oct. 8, 1996

[54] CAST REFRACTORY BASE SEGMENTS AND MODULAR FIBER SEAL SYSTEM FOR SINGLE-STACK ANNEALING FURNACE

[76] Inventor: Gary L. Coble, R.D. #2, Box 214, DuBois, Pa. 15801

[21] Appl. No.: 423,009

[22] Filed: Apr. 14, 1995

Related U.S. Application Data

[63] Continuation-in-part of Ser. No. 32,593, Dec. 21, 1995, Ser. No. 32,592, Dec. 21, 1995, Ser. No. 32,591, Dec. 21, 1995, Ser. No. 32,587, Dec. 21, 1995, Ser. No. 32,589, Dec. 21, 1995, Ser. No. 32,590, Dec. 21, 1995, and Ser. No. 32,588, Dec. 21, 1995.

[51] Int. Cl.[6] ..... C21B 7/02

[52] U.S. Cl. ..... 266/252; 266/280; 266/283; 266/286

[58] Field of Search ..... 266/280, 283, 266/286, 249, 252; 52/596

[56] References Cited

U.S. PATENT DOCUMENTS

| | | | |
|---|---|---|---|
| D. 344,350 | 2/1994 | De Pascale et al. | 52/596 |
| 1,829,320 | 10/1931 | White . | |
| 2,998,236 | 8/1961 | Cramer et al. | 263/10 |
| 3,039,754 | 6/1962 | Jones | 263/47 |
| 3,081,074 | 3/1963 | Blackman et al. | 263/47 |
| 3,149,827 | 9/1964 | Whitten | 263/47 |
| 3,693,955 | 9/1972 | Wald et al. | 266/5 |
| 4,011,683 | 3/1977 | De Sousa | 46/25 |
| 4,287,940 | 9/1981 | Corbett, Jr. | 165/48 |
| 4,294,438 | 10/1981 | Nystrom et al. | 266/280 |
| 4,310,302 | 1/1982 | Thekdi et al. | 432/205 |
| 4,366,255 | 12/1982 | Lankard | 501/95 |
| 4,516,758 | 5/1985 | Coble | 266/263 |
| 4,611,791 | 9/1986 | Coble | 266/263 |
| 4,647,022 | 3/1987 | Coble | 266/282 |
| 4,653,171 | 3/1987 | Coble | 29/455 |
| 4,755,236 | 7/1988 | Coble | 148/13 |
| 5,048,802 | 9/1991 | Coble | 266/263 |
| 5,308,046 | 5/1994 | Coble | 266/263 |
| 5,335,897 | 8/1994 | Coble | 266/286 |

FOREIGN PATENT DOCUMENTS

| | | | |
|---|---|---|---|
| 1131246 | 12/1956 | Germany | 266/262 |

OTHER PUBLICATIONS

Lee Wilson Engineering Co, Brochure Entitled "Lee Wilson–Foremost Engineers & Manufacturers of Annealing Furnaces & Auxiliary Equipment," 8 Pages, Jun. 1968.

*Primary Examiner*—Scott Kastler
*Attorney, Agent, or Firm*—David A. Burge, Esq.

[57] ABSTRACT

A rigid ceramic refractory base for a single-stack annealing furnace is assembled atop a base support structure utilizing a novel set of cast refractory segments, including a pair of C-shaped inner segments and four arcuate outer segments. Defined between the assembled inner and outer segments is a circular inner seal positioning trough that opens upwardly, and that has a tapered cross section that narrows with depth. A resilient but reinforced inner seal of novel form is installed in the trough utilizing upper and lower blankets of refractory fiber material that sandwich a plurality of elongate refractory fiber modules arranged end-to-end to circumferentially fill the trough. Each of the modules includes a serial array of compressed, cube-shaped blocks of fiber refractory material that are interspersed with thin, perforated metal members, with each of the arrays of fiber blocks and metal members being held together to form a module by metal rods that extend centrally therethrough and are welded to perforated metal members that cap opposite module ends. Arcuate steel structures that are assemblable to define an outer seal positioning trough are anchored to the cast refractory outer segments during their fabrication, and have end flanges that enable the cast refractory outer segments to be securely bolted together during assembly of the base. Associated methods of fabrication, assembly, use, maintenance, repair and replacement are disclosed.

112 Claims, 7 Drawing Sheets

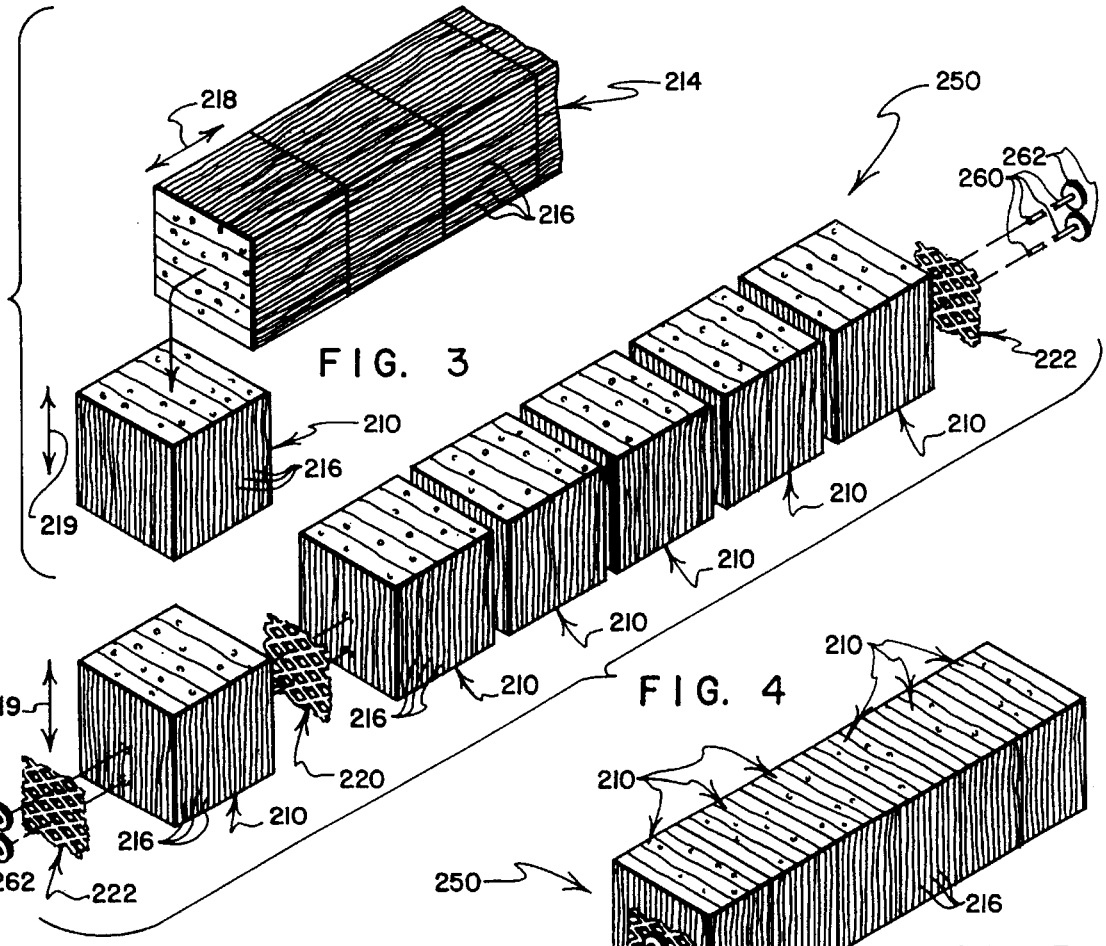
FIG. 3
FIG. 4
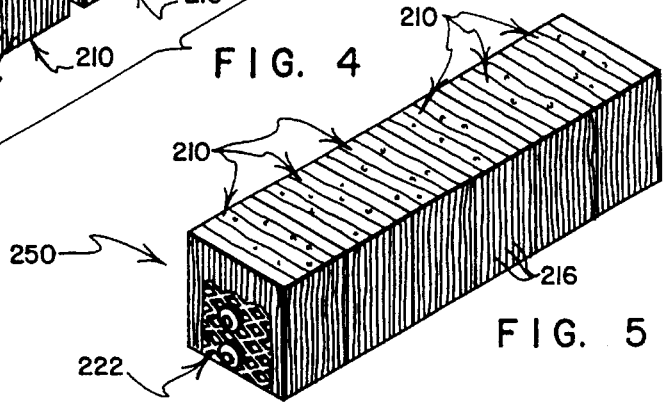
FIG. 5
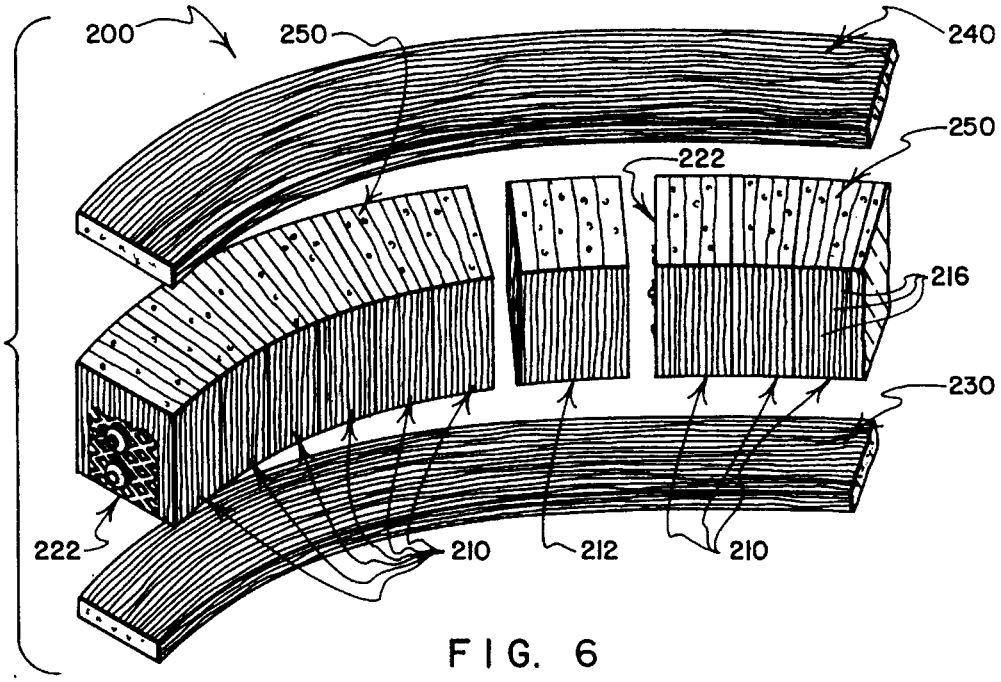
FIG. 6

CAST REFRACTORY BASE SEGMENTS AND MODULAR FIBER SEAL SYSTEM FOR SINGLE-STACK ANNEALING FURNACE

CROSS-REFERENCE TO RELATED APPLICATIONS

The present application is a continuation-in-part of each of the following co-pending applications of Gary L. Coble, referred to hereinafter as the "Cast Refractory Segment Cases," the disclosures of which are incorporated herein by reference:

CAST REFRACTORY CENTER SEGMENT OF ANNEALING FURNACE BASE, Ser. No. 29/032,593 filed Dec. 21, 1995;

CAST REFRACTORY CORNER SEGMENT OF ANNEALING FURNACE BASE, Ser. No. 29/032,592 filed Dec. 21, 1995;

CAST REFRACTORY SIDE SEGMENT OF ANNEALING FURNACE BASE, Ser. No. 29/032,591 filed Dec. 21, 1995;

ASSEMBLY OF CAST REFRACTORY SEGMENTS OF ANNEALING FURNACE BASE, Ser. No. 29/032,587 filed Dec. 21, 1995;

ASSEMBLY OF CAST REFRACTORY SEGMENTS OF ANNEALING FURNACE BASE, Ser. No. 29/032,589 filed Dec. 21, 1995;

ARCUATE CAST REFRACTORY AND STEEL SEGMENT 0F ANNEALING FURNACE BASE, Ser. No. 29/032,590 filed Dec. 21, 1995; and, ASSEMBLY OF ARCUATE CAST REFRACTORY AND STEEL SEGMENTS OF ANNEALING FURNACE BASE, Ser. No. 29/032,588 filed Dec. 21, 1995.

Reference also is made to a concurrently-filed subject-matter related application, Ser. No. (atty's file 5-171) filed (concurrently herewith) by Gary L. Coble entitled CAST REFRACTORY BASE SEGMENTS AND MODULAR FIBER SEAL SYSTEM FOR PLURAL-STACK ANNEALING FURNACE, referred to hereinafter as the "Companion Case," the disclosure of which is incorporated herein by reference.

BACKGROUND OF THE INVENTION

1. Field of the Invention

The present invention relates generally to the heat treating of metal such as coils of steel in a process known as annealing. More particularly, the present invention relates to the provision of and the use, in conjunction with the operation of a single-stack annealing furnace, of a set of novel elongate modules of compressed, reinforced fiber refractory material to form an inner seal of the furnace, with the inner seal preferably including upper and lower blankets of refractory fiber material that sandwich therebetween a tightly packed end-to-end arrangement of the modules that, together with refractory fiber spacer blocks that preferably are utilized to separate adjacent pairs of the modules, circumferentially fill an upwardly opening seal positioning trough that has a cross section that narrows with depth, with the trough preferably being defined between inner and outer members of a novel set of cast refractory segments that form a rigid ceramic refractory base of the furnace. The cast refractory segments and the inner seal modules may be assembled on-site, or at a remote location for transport to and installation as a unit at a furnace site. The invention extends to features of the cast refractory and fiber seal base components, to features of furnace bases assembled from these novel components, to tools that preferably are used in installing, maintaining and repairing fiber seals in annealing furnace bases, and to methods of fabrication, assembly, use, maintenance, repair and replacement.

2. Prior Art

In a single-stack annealing furnace, a fixed base typically is used to centrally support a charge of metal that is to be treated by subjecting the charge to an annealing process which typically includes a lengthy, controlled heating and controlled cool-down process in the environment of a treatment chamber wherein inert gas is circulated. The treatment chamber is defined in large measure by an open-bottom, tank-like inner enclosure of the furnace that is lowered into place once the charge of metal has been positioned centrally atop an inner part of the base. The inner enclosure has a bottom rim that compressively engages an inner seal of the base which extends perimetrically about the inner part of the base. Spaced outwardly from the inner seal is an outer seal that is engaged by an outer enclosure of the furnace that is lowered into seated engagement with the outer seal to heat a furnace chamber within which the inner enclosure is contained, which, in turn, transfers heat energy into the controlled environment of the treatment chamber.

The inner seal typically is called upon not only to seal the treatment chamber 1) against the loss of its controlled gas atmosphere and 2) against contamination of the controlled atmosphere by leakage of ambient air into the treatment chamber, but also to physically support much, if not all, of the weight of the lowered-in-place inner enclosure, the bottom rim of which is seated atop the inner seal once the inner enclosure has been lowered into place. In contrast, the while the outer seal typically is called upon 1) to prevent unwanted loss of heat energy from the furnace chamber and 2) to prevent entry into the furnace chamber of ambient air, the outer seal is seldom required to physically support much, if any, of the weight of the lowered-in-place outer enclosure of the furnace.

Sand has been widely used to form one or both of the inner and outer seals of annealing furnaces. While sand is desirable from the viewpoints 1) of being relatively inexpensive and 2) of being capable (if the sand happens to be distributed in a void-free and uniform manner beneath and along the entire perimeter of a depending rim of a furnace enclosure) to provide a reasonably effective seal, the use of sand in the highly active environment of a steel production facility is quite undesirable due to the fact that grains of sand are small and lightweight in character, and tend to spread themselves about the facility causing severe problems of product contamination.

Unacceptable sand contamination of steel product can result from a single grain of sand being moved out of either of an inner seal trough or an outer seal trough of an annealing furnace. For example, if a grain of sand is lifted above an annealing furnace base during the raising of one of the inner or outer enclosures of the furnace, and if the sand grain falls from the raised enclosure to become lodged in one of the many narrow spaces that may be present among adjacent wraps of a coil of steel, the errant sand grain probably will be pressed into the steel when the steel passes through the rolls of a temper mill, thereby causing an unacceptable product imperfection that, if found to be present very frequently in the output of a mill, may cause customers to purchase elsewhere.

In an effort to eliminate the use of sand seals in annealing furnaces, a wide variety of proposals have been made, some of which have made use of fiber refractory materials of various forms that are laid in place in upwardly opening seal positioning grooves. While sand-substitute fiber seal proposals have, to some degree, been found to serve adequately to provide non-load-bearing outer seals of annealing furnaces, fiber seal proposals for use as load-bearing inner seals have inherently encountered a variety of drawbacks, chief among which has been their unduly high cost of use. Inner seals formed from refractory fiber have tended to be easily damaged during normal service use, have tended to be easily crushed under the weight of the inner enclosures that they must support, have tended to quickly lose their resilience or to otherwise quickly fail to provide gas impermeable barriers, and have, for these and other reasons, tended to require frequent replacement at unacceptably high cost.

Thus, while the desirability of utilizing refractory fiber materials to form outer and inner seals of annealing furnaces has been recognized, a problem that has been encountered in efforts to provide sand-substitute, fiber-type inner seals—a long-standing problem that has tended to defy the finding of a suitable solution—has been the combined need to provide a fiber-type inner seal structure that will remain sufficiently resilient over a suitably lengthy service life to ensure that a gas-impervious seal of good integrity is reliably maintained, while, at the same time, offering sufficient crush resistance and structural integrity to suitably support the weight of an inner furnace enclosure.

While the desirability of utilizing costly, high technology castable refractory materials to form bases of annealing furnaces also has been recognized, efforts that have been made to mold-form these cantankerous materials in situ at the sites of an annealing furnaces have not met with good success. The type of cast refractory materials that are available at present-day that can be mold-formed to provide rigid ceramic structures that will withstand use in a steel production facility where temperatures are repeatedly cycled between ambient temperature and temperatures of about 1500 degrees Fahrenheit (and higher) are low cement containing mixtures that include about 45 to about 47 percent alumina ($Al_2O_3$), about 45 to 47 percent silica ($SiO_2$), and that contain about 2 percent, by weight, of thin stainless steel needles (that typically are about an inch in length and are included to provide strength and reinforcement to the resulting product)—which are mixed with a sufficiently small quantity of water to barely bring the material to a dry granular consistency that can be fed into a mold without causing a cloud of dust to arise as the mix is fed into the mold, and which require the presence of power-induced mold vibration in order to ensure that the material is properly distributed throughout the mold to form a mixture of even consistency that can be cured to form a strong, temperature-cycle-resistant product.

To achieve the uniformity and high density of refractory material that is needed in the resulting product, it is important that the water content of a cast refractory mix be carefully controlled and kept to a minimum, that the vibration that is applied to the mold be sufficiently powerful to thoroughly vibrate the mold for substantially the entire period of time that the mold is being filled, and that the newly molded product be carefully cured in a temperature controlled environment—little, if any, of which tends to be properly carried out if what one tries to do is to mold an annealing furnace base in situ at a furnace site.

Forming cast refractory members to provide components of annealing furnace bases has even proved to be a difficult undertaking to carry out in a specialized cast refractory production facility due to the enormous size and weight of the members that need to be formed, and due to the massive amounts of cast refractory material that need to be aggressively vibrated into place in massive molds or forms. If base components are made that are too small in size, the number of components that must be installed, the nature of the mistakes that can be made in installing components, and problems of component breakage unduly complicate the work of effecting full-base replacements. On the other hand, the larger that components are made, the heavier they are to move, the more difficult they are to properly position, and the less forgiving they are of accommodating dimensional irregularities that are encountered to some degree in almost every base replacement endeavor. Finding a "right approach" to the sizing and shaping of remote-facility-molded cast refractory segments for annealing furnace bases has proved to be elusive.

While efforts have been made to mold whole furnace bases and base portions off-site at facilities that specialize in the fabrication of mold-formed castable refractory structures by mold-forming castable refractory materials, such efforts have met with very differing degrees of success depending often on the extent to which success can be had in transporting the resulting structures to, and in crane-lifting such structures into place at, a furnace site. Trying to use lift truck forks to maneuver cast refractory structures, and trying to lift and position cast refractory structures utilizing crane-supported cables that wrap about or otherwise engage outer surfaces of the newly molded cast refractory structures tends to cause unacceptable chipping, cracking and breakage. Moreover, incorrectly stressing or inadequately supporting these massively heavy cast structures during transport or during lifting or positioning, can easily cause the newly cast structures to break apart under their own weight.

Thus, while the desirability of forming cast refractory annealing furnace bases has been recognized, the need for a practical method that will actually enable cast refractory bases of high structural integrity and offering reliably good performance characteristics to be provided and installed with excellent consistency has gone unfulfilled.

Another problem that has been encountered with annealing furnace bases is the severe warping and cracking of, and hence the need for frequent replacement of, structural steel that typically is welded in place in the vicinities of the inner or outer seals of the furnace. Inner walls of the outer seal troughs of annealing furnaces have, for example, typically been formed from structural steel that is held in place by virtue of being welded to an underlying base support structure of the furnace; and this structural steel often is found to warp severely and to break loose from its welds long before the service life of an adjacent cast ceramic base has come to a close.

Because structural steel does not fare well when subjected to repeated cycling between ambient temperature and elevated temperatures of up to 1500 degrees Fahrenheit (and higher), and because welds of structural steel also perform poorly when subjected to repeated temperature cycles of this type, it has been recognized as being desirable to eliminate or minimize the use of structural steel and structural steel welds in the vicinities of the inner and outer seals of annealing furnaces. However, it has been widely accepted that cast refractory materials do not have sufficient strength and sufficient impact resistance to be used either in place of such structural steel or in reinforcing welded steel structures that may need to be used to define the outer seal trough of an annealing furnace. Some of the features of the present invention break new ground in successfully employing cast refractory materials in unconventional uses of this type.

Because the base structures of annealing furnaces are subjected to repeated cycles of high temperature heating followed by cooling, and because heavy loads are imposed on these structures as both massive charges of metal and heavy furnace enclosures are moved into and out of position, annealing furnace base structures need to be serviced and repaired frequently, and replaced regularly as a part of scheduled programs of maintenance—which is true regardless of the character of the materials from which the bases are formed. Far too much "down time" presently is needed to maintain, repair and replace the bases of annealing furnaces. Bases are needed, and base maintenance, repair and replacement tools and techniques are needed, that will permit the maintenance, repair and replacement of annealing furnace bases to be carried out while requiring much less "down time."

3. The Referenced Cases

The referenced Cast Refractory Segment Cases disclose a number of annealing furnace base segment configurations that can be used in conjunction with features of the preferred practice of the present invention. The referenced Companion Case discloses a preferred manner in which features of the present invention, together with other invention features, are put to use in the environment of a plural stack annealing furnace. Due to the related nature of these referenced cases, their disclosures are incorporated herein, by reference.

SUMMARY OF THE INVENTION

The present invention addresses the foregoing and other needs and drawbacks of the prior art by providing a number of novel and improved features, some of which are capable of being used with existing forms of single-stack furnace bases, but many of which are preferably and most advantageously used in combination to provide an improved single-stack annealing furnace base that is characterized by excellent longevity of service, by reliable and lengthy inner seal performance, and by the utilization of modular components that can be maintained, repaired and eventually replaced with relative ease and convenience, and with minimal furnace "down time."

A significant aspect of the preferred practice of the present invention relates to the provision of a set of cast refractory and modular fiber seal components for a single-stack annealing furnace base that lend themselves quite nicely to either of two modes of base assembly: namely, 1) to being transported to a furnace site in modular form (i.e., as a set of unassembled components) for being assembled at the furnace site, or 2) to being fully assembled to form a furnace base at a remote, "off-site" location, and then being transported to and final-positioned at a furnace site as a fully assembled unit.

If on-site assembly is elected, such portions of an existing welded steel base support structure of an annealing furnace as may need to be repaired or replaced are attended to, or a new welded steel base support structure is provided and is lifted into position. Atop the base support structure, an initial blanket of refractory fiber material is laid in place; cast refractory segments of the new base are installed side by side atop the initial blanket; and a novel set of inner seal components that embody features of the invention is installed in an inner seal positioning trough of tapered cross-section that is defined between inner and outer segments of the cast refractory base, as will be described later herein.

If off-site assembly is elected, a new welded steel base support structure is provided; an initial blanket of fiber refractory together with cast refractory segments and the novel modular-segment inner seal assembly are installed; and the fully assembled base is trucked to the furnace site to be lifted in place as soon as an existing base and its debris are cleared away. Tools and techniques that preferably are employed when a single-stack annealing furnace base is assembled, either on-site or off-site, utilizing a novel set of modular components, also constitute features of the present invention.

A significant feature of the preferred practice of the present invention has to do with the provision of a novel set of elongate fiber seal modules of compressed, reinforced fiber refractory material that preferably are utilized in combination with a set of spacer blocks of fiber refractory material and a pair of elongate blankets of fiber refractory material to form at least the inner seal of a single-stack annealing furnace, it being understood that the outer seal of the furnace also can be formed utilizing substantially the same components. The use of compressed, reinforced fiber refractory modules together with other fiber refractory components to form an inner seal that will retain needed resilience during a lengthy service life while also providing a capability to properly support a heavy inner enclosure of the furnace represents a significant advance in the art.

Another feature of preferred practice has to do with techniques that are used to tightly pack the novel fiber seal modules end-to-end and downwardly into an upwardly opening inner seal positioning trough that is defined between inner and outer cast refractory base segments to form a particularly effective inner seal that has been found to perform exceptionally well over a lengthy service life. Tests have shown that a typical inner seal formed in accordance with the preferred practice of the present invention will permit an inert gas pressure of 5 ounces per square inch (above ambient air pressure) to be maintained in a treatment chamber—which is about five times the gas pressure that typically has been reliably attainable and maintainable with previously proposed seals that make use of some form of fiber refractory. The seal installation techniques that have been developed that permit use of compressed, reinforced fiber modules together with spacer blocks and a set of upper and lower blankets of fiber refractory to define a much improved seal also represent a significant step forward in the art.

Still another feature of the preferred practice of the present invention relates to techniques and tools that preferably are utilized to maintain and rejuvenate the fiber seal assembly of a single-stack base to ensure that it performs well during the course of a lengthy service life. In preferred practice, the trough-carried, tightly packed, end-to-end arrangement of fiber seal modules is sandwiched between an overlying upper blanket of fiber refractory material, and an underlying lower blanket of refractory fiber material, with the upper blanket being replaced from time to time as part of an ongoing program of scheduled maintenance. The seal is rejuvenated from time to time by utilizing a special compression and shaping tool that simultaneously engages the full circumferential length of the upwardly facing surface of the seal 1) to press-shape the top surface of the seal, and 2) to ensure that all components of the seal are properly pressed down into the enclosing trough so that the seal will properly receive and make sealing engagement with the bottom rim of an inner enclosure when an inner enclosure is lowered into seated engagement with the seal.

The seal compression and shaping tool also is used beneficially during seal installation, repair and replacement. Fiber seal installation, rejuvenation, maintenance and replacement techniques that preferably are utilized to achieve good fiber seal performance and to maintain good seal performance throughout a lengthy service life also constitute aspects of the present invention.

In accordance with another feature of preferred practice, a single-stack base is provided with an upwardly opening inner seal positioning trough that has a cross-section that narrows with trough depth, with the trough being defined between inner and outer members of a novel set of cast refractory segments that form a rigid ceramic refractory base of the furnace. Inner segments of the cast refractory base define one of two opposed sides of the inner seal positioning trough; outer segments define the other; and the segment surfaces that define opposite sides of the trough preferably provide a trough cross-section that narrows with depth to assist in maintaining a tight fit with refractory fiber components of the inner seal as these components tend to be pressed downwardly into the trough by the weight of an inner enclosure of the furnace seated atop the inner seal. The use of a set of inner and outer cast refractory segments to define a tapered inner seal positioning trough that aids in keeping the inner seal tightly in place in the trough throughout its service life also constitutes a significant feature of preferred practice.

Another aspect of preferred practice relates to the provision of a single-stack annealing furnace base that utilizes a novel set of inner and outer cast refractory segments to form a rigid ceramic refractory base, with the outer segments of the base having welded steel structures integrally anchored to the cast refractory material of the outer segments for defining an outer seal positioning trough that encircles the assembled refractory base. The steel structures have anchor formations that extend into molds that are utilized to form the cast refractory outer segments, whereby, when the cast refractory outer segments are mold-formed, they are securely anchored to the adjacent steel structures and function well during lengthy service lives to reinforce the steel structures to minimize steel warpage during the lengthy service lives that typically are exhibited by the cast refractory segments.

Another feature provided by the steel structures that are anchored to the novel cast refractory outer segments is that the steel structures have end flanges that extend side by side when the outer segments of a base are assembled, and that can be securely bolted together to assist in holding the outer segments in place. The provision of cast refractory outer segments that can be easily bolted together during base assembly facilitates base assembly and disassembly, and provides a means by which a damaged outer segment can be quickly disconnected from the base and replaced, if need be.

In accordance with still another feature, installation, removal and replacement of the cast refractory segments is facilitated by providing each and every one of the cast refractory segments with three lift engageable formations that are anchored securely into the cast refractory material of each segment, and that can be connected to a three-armed lifting fixture that is designed to support the cast refractory segments in horizontally extending attitudes as the segments are positioned and installed with the aid of a crane. This combination of a triumvirate of segment-anchored lift connections and the use of a three-arm lifting fixture obviates the need to wrap cables about, or to otherwise bring lifting devices directly into contact with outer surfaces of cast refractory segments, and provides a means by which segments can be final positioned without having to be pried into place or otherwise man-handled in ways that might detrimentally affect the integrity of the cast segments.

BRIEF DESCRIPTION OF THE DRAWINGS

Other features and a fuller understanding of the invention may be had by referring to the following description and claims taken in conjunction with the accompanying drawings, wherein:

FIG. 3 is a perspective view, on an enlarged scale, illustrating somewhat schematically, how cube-shaped blocks of refractory fiber insulation can be cut from a log of refractory fiber insulation for use in forming fiber seal modules;

FIG. 4 is an exploded perspective view depicting selected components of a fiber seal module of the type that preferably is utilized to form at least the inner seals that are employed in single-stack annealing furnace bases in accordance with the preferred practice of the present invention;

FIG. 5 is a perspective view of an assembled one of the fiber seal modules;

FIG. 6 is an exploded perspective view illustrating fiber seal modules, spacer blocks and a pair of upper and lower blankets of refractory fiber insulation that preferably are utilized in forming at least the inner seals in single-stack annealing furnace bases;

DESCRIPTION OF THE PREFERRED EMBODIMENT

Figure 1:
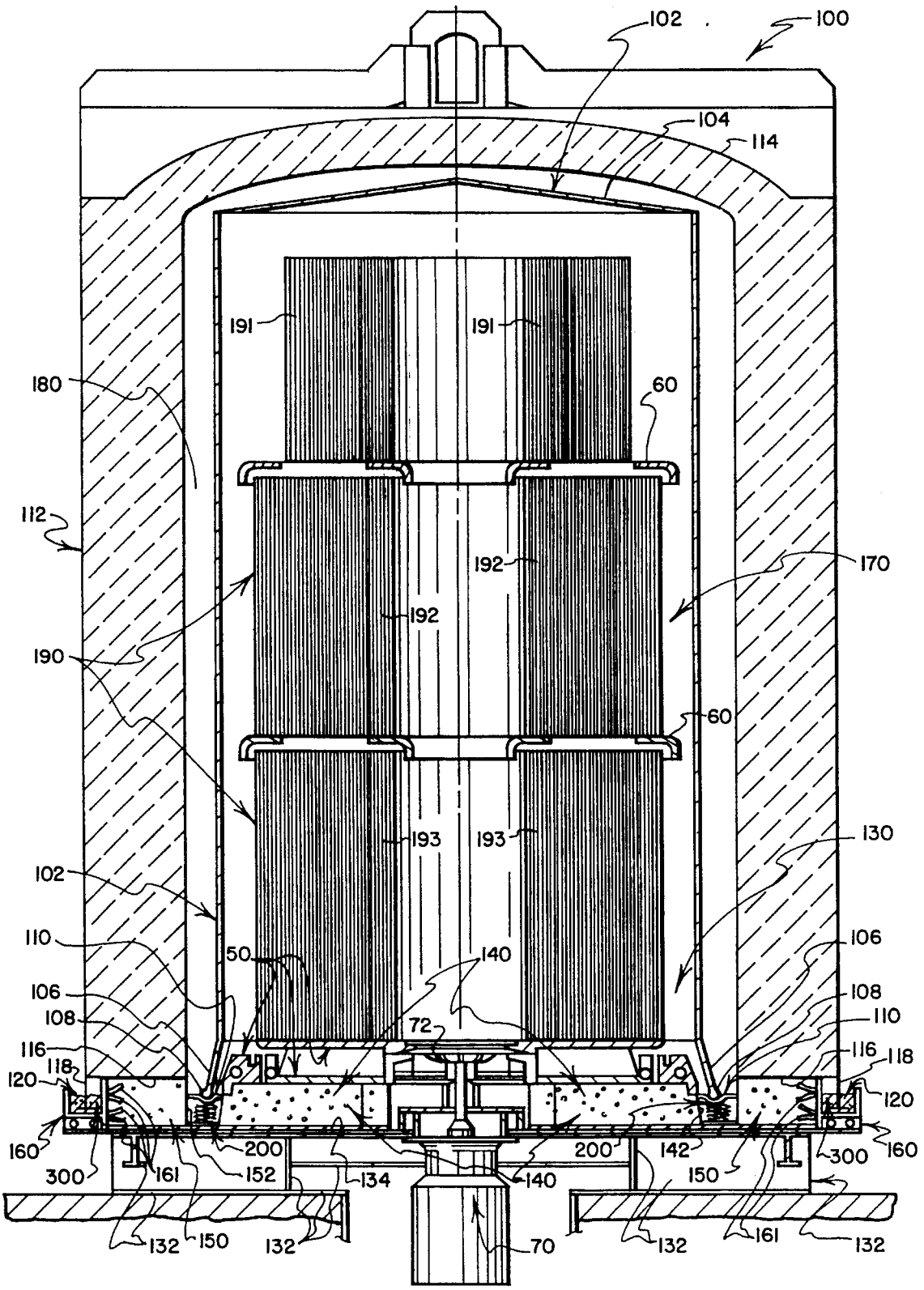
FIG. 1 is a vertical cross-sectional view depicting portions of a single-stack annealing furnace that has cast refractory base segments and a modular fiber seal system that embody features of the preferred practice of the present invention.

Referring to FIG. 1, an annealing furnace that incorporates novel and improved base features representing the preferred practice of the present invention is indicated generally by the numeral 100.

Except for the novel and improved base features that will be described shortly, the furnace 100 preferably is of the general type that has its structure and operation described in detail in the following patents of Gary L. Coble, referred to hereinafter as the "Annealing Furnace Patents," the disclosures of which are incorporated herein by reference, namely: 1) DIFFUSER SYSTEM FOR ANNEALING FURNACE, U.S. Pat. No. 4,516,758 issued May 14, 1985; 2) DIFFUSER SYSTEM FOR ANNEALING FURNACE WITH WATER COOLED BASE, U.S. Pat. No. 4,611,791 issued Sep. 16, 1986; 3) METHOD OF ANNEALING USING DIFFUSER SYSTEM FOR ANNEALING FURNACE WITH WATER COOLED BASE, U.S. Pat. No. 4,755,236 issued Jul. 5, 1988; and, 4) DIFFUSER SYSTEM FOR ANNEALING FURNACE WITH CHAIN REINFORCED, NODULAR IRON CONVECTOR PLATES, U.S. Pat. No. 5,048,802 issued Sep. 17, 1991.

Referring to FIG. 1, the furnace 100 includes a conventional, generally cylindrical inner enclosure 102, and a generally cylindrical outer enclosure 112. The enclosures 102, 112 have closed upper ends 104, 114 and open lower ends 106, 116, respectively. The inner enclosure 102 has a depending rim formation 108 that extends into an upwardly opening inner seal trough 110 for sealingly engaging an inner seal 200 that is carried in the inner seal trough 110. The outer enclosure 112 has a depending knife edge formation 118 that extends into an upwardly opening outer seal trough 120 for sealingly engaging an outer seal 300 that is carried in the outer seal trough 120.

A base of the furnace 100 is indicated generally by the numeral 130. The base 130 has a cast refractory "upperstructure" and a welded steel "understructure." The understructure is provided by a welded steel assembly that will be referred to as a "base support structure," which is indicated generally by the numeral 132. While welded steel base support structures of a wide variety of configurations (incorporating structural steel components in a variety of arrangements that are not of any particular relevance to the practice of the present invention) are used in annealing furnaces, almost all of the various forms of base support structures that currently are in service include, or easily can be provided with, a relatively large, flat plate 134 for underlying and supporting a cast refractory part of the base 130. It is important that the plate 134 be substantially flat and of good integrity. If a base 130 is to be rebuilt that has a warped plate 134 (or a plate 134 that has gone through so many annealing furnace cycles that it is likely to warp or fail), the existing plate should be replaced with a new plate 134.

The cast refractory part of the base 130 can be thought of as comprising two basic elements, namely a cast refractory "inner base structure" 140 and a cast refractory "outer base structure" 150. In preferred practice, a blanket 136 of refractory fiber insulation is interposed between the plate 134 and the inner and outer base structures 140, 150. The blanket 136 also underlies the inner seal trough 110. While the blanket 136 is depicted in FIGS. 7 and 8 as having a thickness of typically about an inch (i.e., it is depicted as being about as thick as the plate 134), it will be understood that the blanket 136 tends to flatten under the heavy weight of the cast refractory inner and outer structures 140, 150, and under the heavy weight of the inner enclosure 102 when the inner enclosure 102 is seated atop the inner seal 200.

Figure 7:
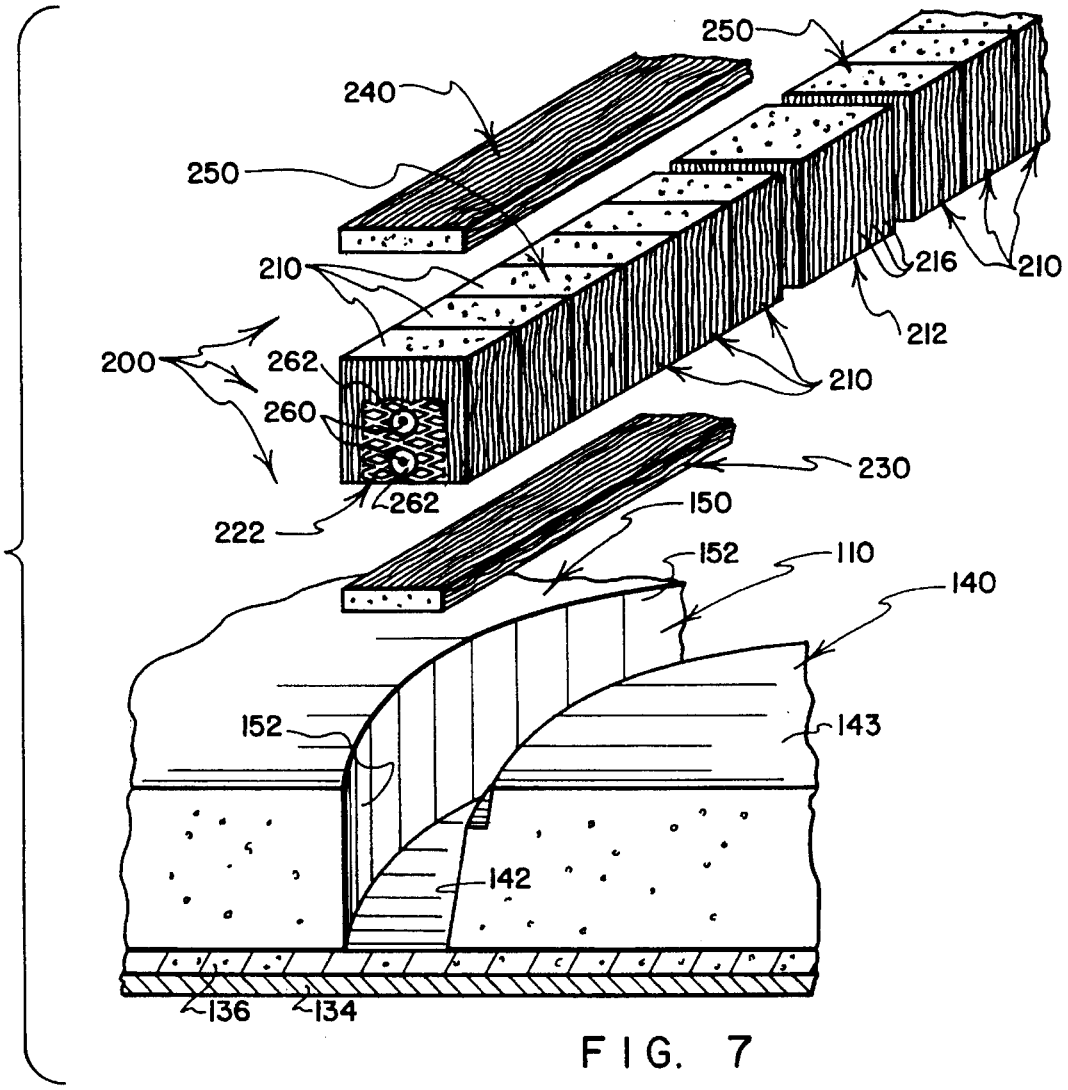
FIG. 7 is an exploded perspective view depicting on an enlarged scale portions of an inner seal positioning trough that is defined between inner and outer segments of the cast refractory base of the furnace of FIG. 1, and depicting selected components that preferably are utilized in forming a fiber seal within the inner seal trough.
Figure 8:
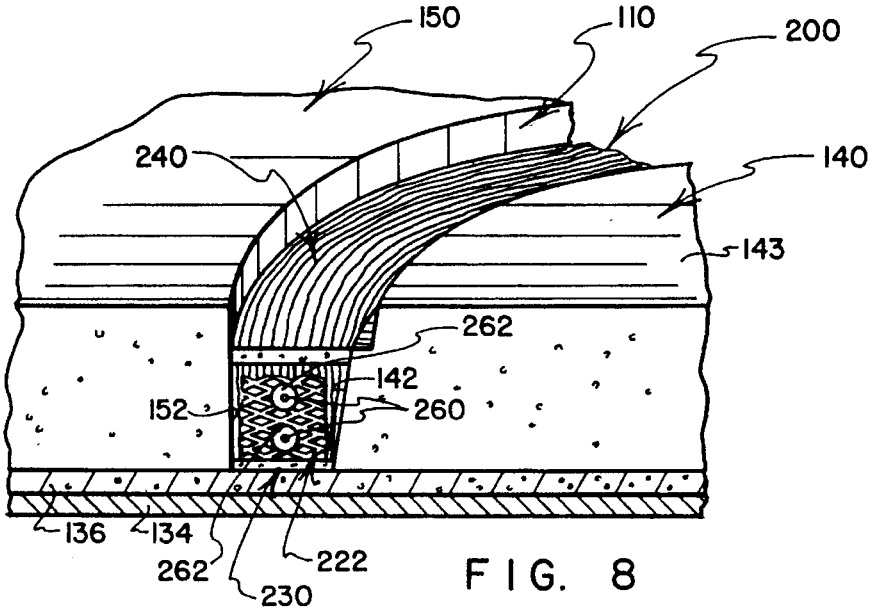
FIG. 8 is a perspective view similar to FIG. 7 but with the fiber seal components of FIG. 6 installed in the inner seal trough to form an inner seal.

Referring to FIGS. 1, 7 and 8, the inner seal trough 110 (within which the inner seal 200 is positioned) constitutes an annular, upwardly opening space that is defined atop the plate 134, atop the blanket 136, and between the cast refractory inner and outer base structures 140, 150. A circumferentially extending, radially outwardly facing surface 142 of the inner base structure 140, and an opposed, radially inwardly facing surface 152 of the outer base structure 150 define opposite sides of the inner seal positioning trough 110.

The opposed surfaces 142, 152 extend substantially concentrically about the generally circular inner structure 140, and thereby cooperate to define a cross-section of the inner seal trough 110 that remains substantially constant along the entire circumferentially extending length of the trough 100—a cross-section that preferably has a width that narrows with trough depth. The desired diminishment of the width of the inner seal positioning trough 110 with trough depth can be achieved by inclining either or both of the surfaces 142, 152 that define opposite sides of the trough 110.

Figure 11:
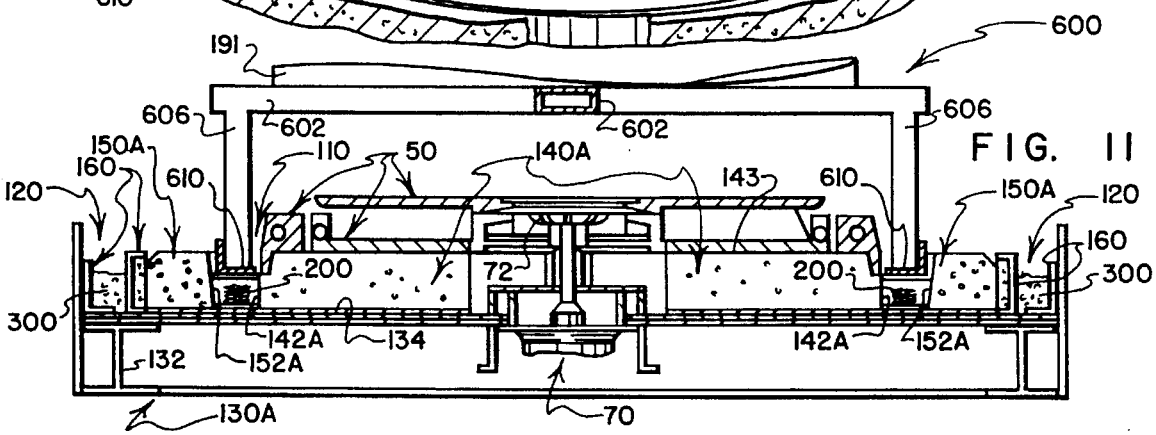
FIG. 11 is a sectional view that shows features of an alternate form of base that embodies features of the present invention, with the tool of FIG. 9 seated atop the inner seal of the base.

For example, in FIG. 1 the inner surface 142 of the trough 110 is depicted as being inclined with respect to the vertical—preferably to diminish trough width by about one inch per six inches of trough depth—whereas the outer surface 152 is depicted as extending substantially vertically. In FIG. 11, however, the outer trough surface 152A of a cast refractory outer structure 150A is depicted as being inclined with respect to the vertical—again with about a 1:6 ratio that diminishes trough width about one inch per six inches of trough depth—whereas the inner surface 142A of a cast refractory inner structure 140A is depicted as extending substantially vertically.

A variety of outer seal embodiments can be used in annealing furnace bases that employ the fiber type inner seals that correspond to the preferred practice of the present invention (features of the fiber seal will be described later herein). For example, in the furnace base embodiment 130A of FIG. 11, a somewhat differently configured outer seal trough 120A is depicted that contains a relatively conventional outer seal 300A formed from sand, much as the outer seal 300 depicted in FIG. 1 is also formed from sand.

Inasmuch as the furnace bases 130, 130A that are depicted in FIGS. 1 and 11, respectively, have much in common, similar reference numerals are utilized in the drawings to depict similar features of the bases 130, 130A. Reference numerals that are "identical" are utilized in FIGS. 1 and 11 to designate features and components that are "identical." Components of the base 130A shown in FIG. 11 that differ a bit in configuration from the components of the base 130 shown in FIG. 1 are indicated by reference numerals that "correspond" to those used in FIG. 1 except for the addition thereto of the letter "A."

Figure 2:
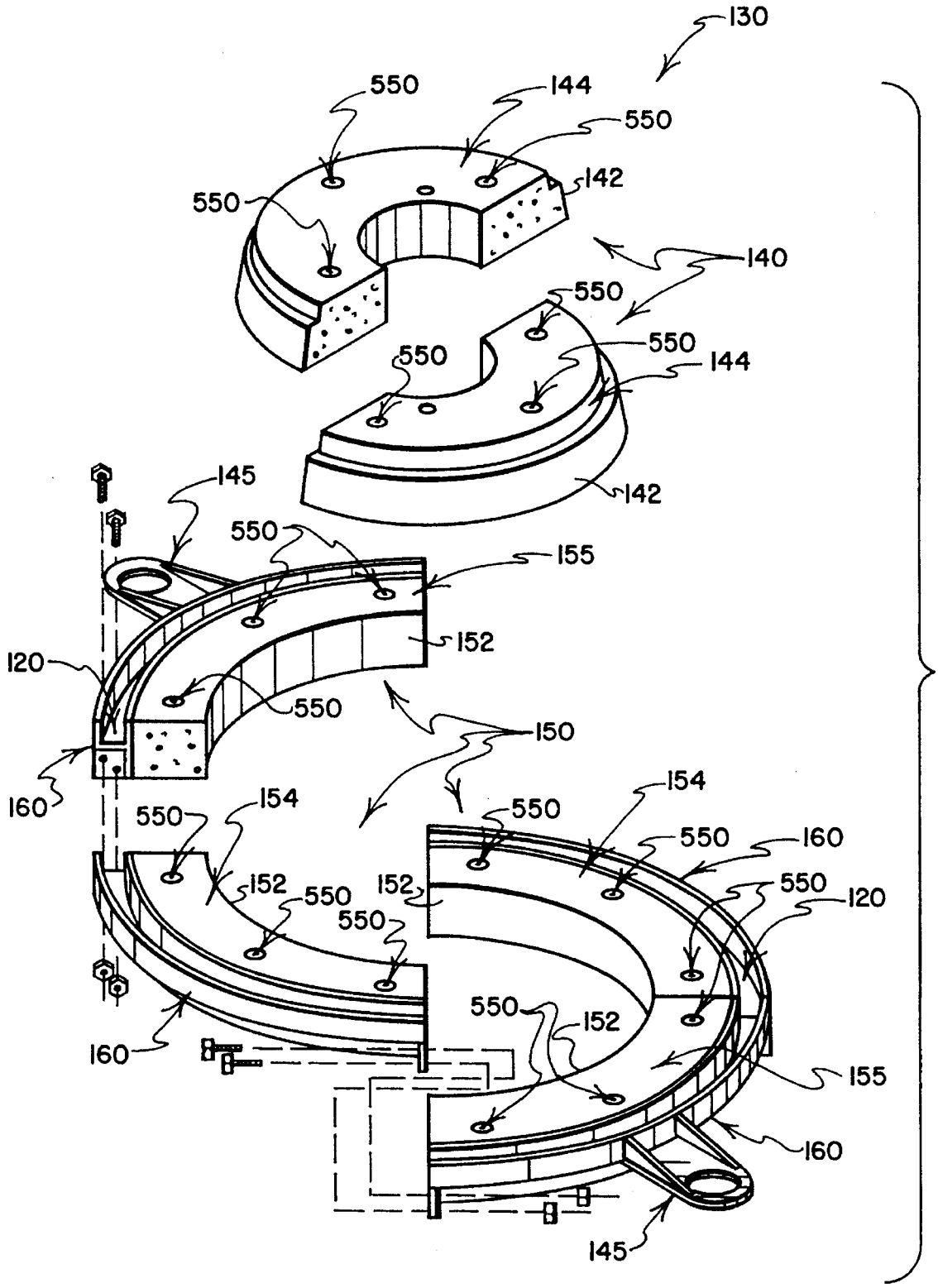
FIG. 2 is an exploded perspective view depicting cast refractory base segments that are utilized in the base of the furnace of FIG. 1.

Referring to FIGS. 1 and 2, the outer seal trough 120 of the preferred furnace base embodiment 130 is defined by steel structure 160 that has anchor extensions 161 that project into the cast refractory material that is mold-formed to fabricate the outer base structure 150 (the manner in which mold-formation of the inner and outer base structures 140, 150 from castable refractory material is carried out is described later herein), whereby the steel structure 160 is securely anchored to the cast refractory outer structure 150. In the less preferred furnace base embodiment 130A of FIG. 11, an outer seal trough 120A is defined by structural steel members 160A that are welded to the underlying plate 134.

It is the function of the inner seal 200 (which is depicted uniformly throughout the drawings as taking a single preferred form that will be described in detail later herein), to cooperate with the depending rim 108 of the inner enclosure 110 to maintain a closed environment treatment chamber 170 within which a charge of metal 190 can be supported for being subjected to an annealing process wherein a positive pressure, non-oxidizing atmosphere typically is maintained within the treatment chamber 170 (i.e., within the inner enclosure 110) while a furnace chamber 180 (defined within the outer enclosure 120) is heated by conventional furnace structure (not shown) to bring the treatment chamber 170 to a desired elevated temperature, whereafter controlled cooling of the charge of metal 190 is permitted to take place in the treatment chamber 170 to bring the charge of metal 190 back to near ambient temperature.

Referring to FIG. 1, the charge of metal 190 that typically is treated in the furnace 100 includes a plurality of coils 191, 192, 193 of steel, with convector plates 60 being inserted between adjacent pairs of the coils to space the coils apart and to provide for circulation of gas therebetween. A desirable type of convector plate 60 to use for such a purpose is described in Coble U.S. Pat. No. 5,048,802. To support the charge of metal 190 atop the cast refractory components of the base 130 (and the same is true with respect to the base 130A of FIG. 11), an assembly of metal base components, that form what is referred to as a "diffuser base," indicated generally by the numeral 50, is positioned atop the cast refractory inner structure 140. Desirable types of diffuser base components 50, and the preferred manner in which these components are utilized, are described in detail in the above-identified Annealing Furnace Patents of Gary L. Coble.

A fan 70 having a rotary impeller 72 is disposed substantially centrally among the metal base components 50 for circulating non-oxidizing gases within the closed environment of the treatment chamber 170. During an annealing operation, the fan 70 is operated to circulate an inert gas within the treatment chamber 170 among the coils of steel 191, 192, 193 while a furnace heating system (typically carried by the outer enclosure 112, but not shown in the drawings inasmuch as the nature of heating systems used by annealing furnaces are quite well known and forms no part of the present invention) heats the furnace chamber 180 so that the inner enclosure 102 is heated which, in turn, causes the gases within the treatment chamber 170 to be heated. The temperature of the gases that are circulated within the treatment chamber 170 typically is elevated to as high as 1500 degrees Fahrenheit (sometimes higher) for a period of time sufficient to heat and treat the steel that forms the coils 191, 192, 193, and then is slowly lowered to ambient temperature to complete the annealing process, whereafter the enclosures 102, 112 are raised to permit the coils 191, 192, 193 to be removed, and to the process to be repeated with a new charge of metal.

Referring to FIG. 2, the cast refractory inner and outer base structures 140, 150 of the base 130 of the furnace 100 are defined by a pair of C-shaped cast refractory inner segments 144, and by two pairs of quarter-circle-shaped cast refractory outer segments 154, 155. The C-shaped inner segments 144 are identical one with another and, when positioned side by side to face toward each other, cooperate to define the radially outwardly facing surface 142 that extends along a curved inner surface of the inner seal 200. The quarter-circle-shaped outer segments 154, 155 are identical one with another except for the projection from the steel structures 160 of the segments 155 of formations 145 that are utilized in some annealing furnace installations to receive elongate upstanding guide pins (not shown) that guide movements of the outer enclosure 112 of the furnace 100. When the outer segments 154, 155 are positioned to cooperate in defining the annular outer structure 150 that extends in spaced concentric relationship about the inner structure 140, curved inner surfaces of the segments 154, 155 cooperate to define the inwardly facing surface 152 that extends along a curved outer surface of the inner seal 200.

Each of the cast refractory segments 144, 154, 155 is "cast" (i.e., each is individually formed in a separate mold—which molds must be quite large in size inasmuch as the segments 144, 154, 155 that are to be formed also are quite large in size), utilizing a castable refractory material that, when set and cured, will provide segments 144, 154, 155 that will withstand some reasonable amount of being bumped about while being transported to and installed at a furnace site.

While improvements in, and new forms of, castable refractory materials are constantly being made, the preferred type of castable refractory material that presently is utilized to mold-form the segments 144, 154, 155 to provide rigid ceramic structures that will withstand use in a steel production facility where temperatures are repeatedly cycled between ambient temperature and temperatures of about 1500 degrees Fahrenheit (and higher) are low cement containing mixtures that include about 45 to about 47 percent alumina ($Al_2O_3$), about 45 to 47 percent silica ($SiO_2$), and that contain about 2 percent, by weight, of thin stainless steel needles (that typically are about an inch in length and are included to provide strength and reinforcement to the resulting product)—which are mixed with a sufficiently small quantity of water to barely bring the material to a dry granular consistency that can be fed into a mold without causing a cloud of dust to arise as the mix is fed into the mold, and which require the presence of power-induced mold vibration in order to ensure that the material is properly distributed throughout the mold to form a mixture of even consistency that can be cured to form a strong, temperature-cycle-resistant product.

While castable refractory materials of the type just described are commercially available from a variety of sources, a presently preferred castable refractory is sold by Premier Refractories and Chemicals, Inc. of King of Prussia, Pa. 19406 under the product designation "Criterion 45," which is described as being an alumina and silicate based, general-duty, low cement containing, vibration castable that needs to be mixed with relatively little water, and that can provide cast products of relatively high density, relatively low porosity, and relatively high strengths—as compared with products produced from other forms of present-day-available cast refractory materials. Cast refractory products formed with this material are understood to perform in environments that are cycled repeated between ambient temperature and elevated temperatures as high as about 2800 degrees Fahrenheit.

Figure 12:
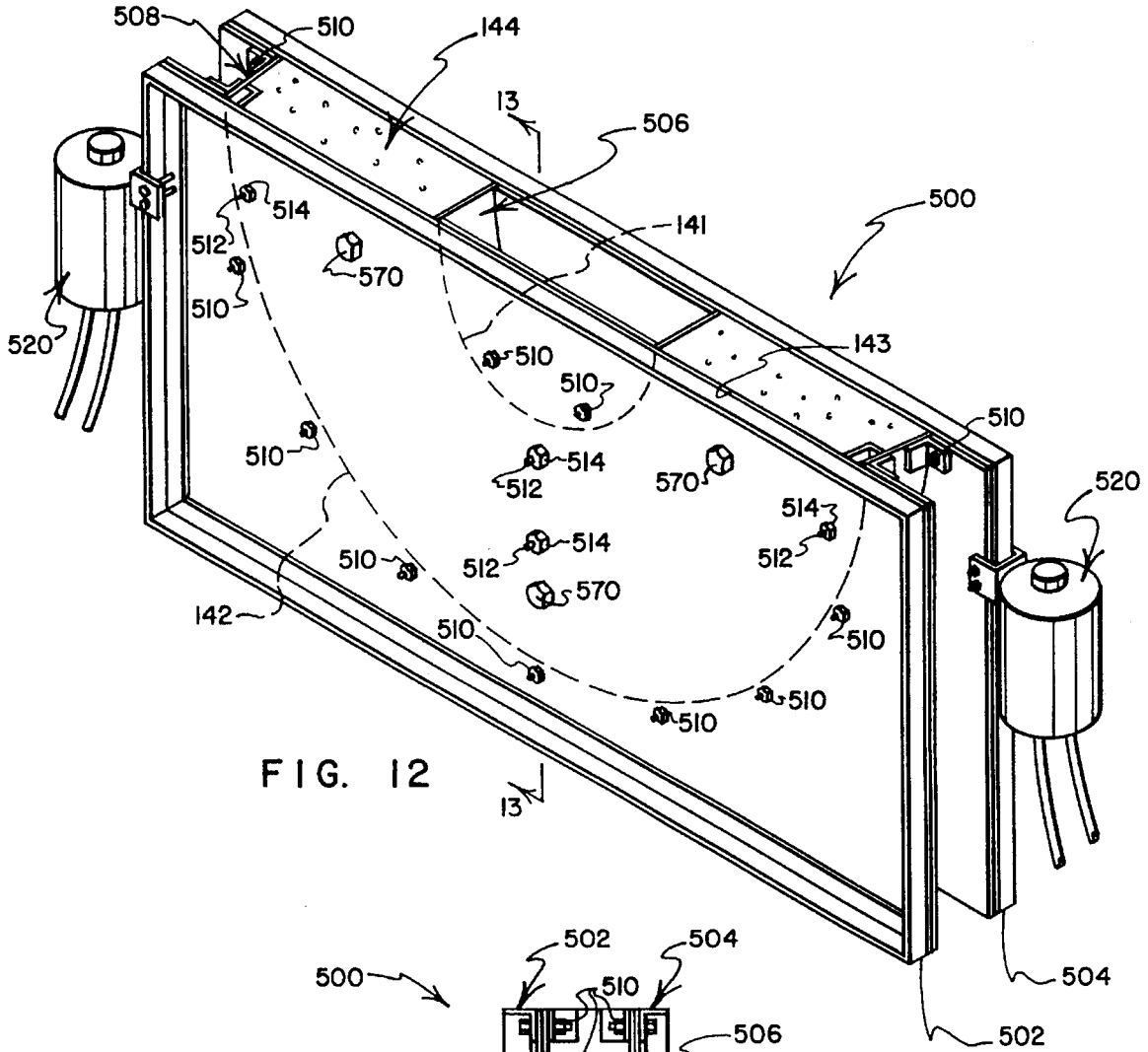
FIG. 12 is a perspective view of a disassemblable mold of the general type that preferably is utilized to mold-form castable refractory material to cast the inner and outer cast refractory segments that are employed in annealing furnace bases that embody the preferred practice of the present invention, with a pair of power operated mold vibrators clamped to the mold for vibrating the mold during the introduction into and distribution within the mold of castable refractory material.
Figure 13:
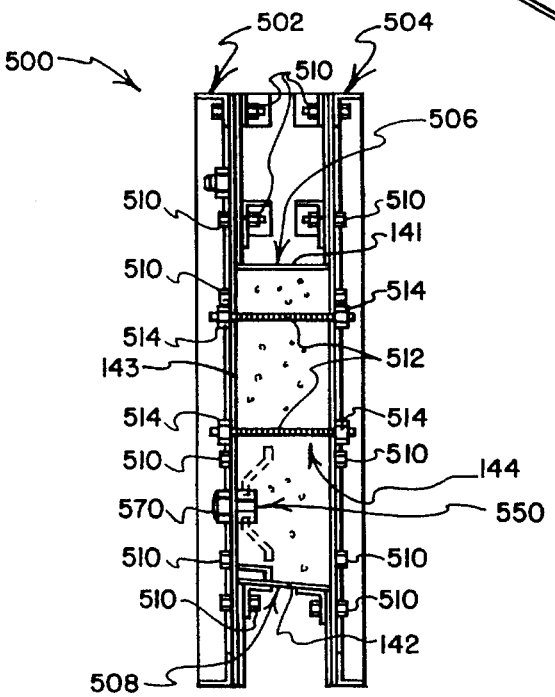
FIG. 13 is a sectional view as seen from a plane indicated by a line 13—13 in FIG. 12.

Referring to FIGS. 12 and 13, a typical form of disassemblable steel mold that preferably is utilized to form one of the C-shaped inner segments 144 is indicated by the numeral 500. The mold 500 has a pair of opposed front and rear side structures 502, 504 that preferably are formed as welded assemblies from structural steel forms such as angle iron, and steel plate stock. Curved inner and outer surfaces 141, 142 of a C-shaped segment 144 are formed by appropriately curved steel plates 506, 508 that are installed between the front and rear structures 502, 504. Bolts 510 extending through appropriately positioned bolt holes are utilized to connect the front and rear structures 502, 504 to the curved plates walls 506, 508—and are removable to permit the mold 500 to be disassembled when a newly molded segment 144 is to be removed therefrom.

Also serving to tie the front and rear structures together are four threaded rods 512 that extend through aligned holes formed in the front and rear structures 502, 504, and through the segment-defining cavity of the mold 500, with opposite ends of the rods 512 being connected to the structures 502, 504 by nuts 514.

Referring to FIG. 12, in order to powerfully vibrate the mold 500 during the feeding into and during distribution within the mold 500 of castable refractory material, a pair of commercially available mold vibrator units 520 (typically pneumatically operated) are shown clamped to opposite corner regions of the mold 500. The vibrator units 520 are widely available, and are commonly employed when "vibration casting" is called for, as will be readily understood by those who are skilled in the art.

The front structure 502 of the mold 500 forms a "top" surface 143 of a C-shaped inner segment 144 that is being formed in the mold 500—meaning that, when the inner segment 144 is positioned for use in the furnace 100, the surface 143 will face upwardly. To facilitate the connecting of a crane to the segment 144 for use in moving the segment from place to place (and in final positioning the segment 144 at a furnace site), three identical lift connectors 550 are embedded within the segment 144 during molding of the segment 144, one of which is depicted in the sectional view of FIG. 13, but is best seen in the sectional view of FIG. 16.

Figure 15:
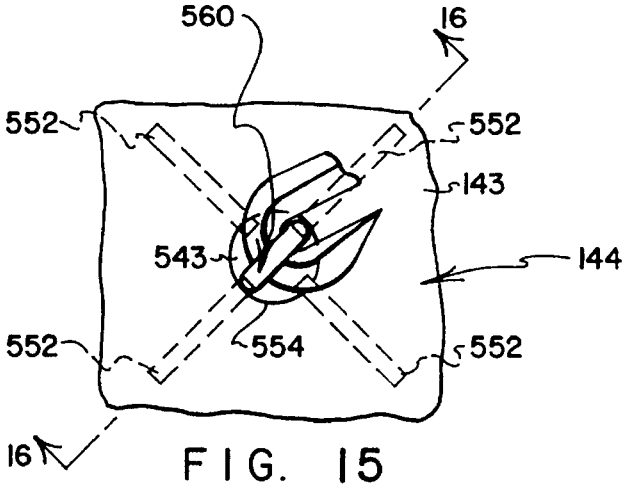
FIG. 15 is a top plan view on an enlarged scale of a portion of the segment of FIG. 14, as seen from a plane indicated by a line 15—15 in FIG. 14, with hidden lines depicting the deployment of anchor portions of a typical one of the three lift connections that extend into the cast refractory material of the segment; and, FIG. 16 is a sectional view as seen from a plane indicated by a line 16—16 in FIG. 15.
Figure 16:
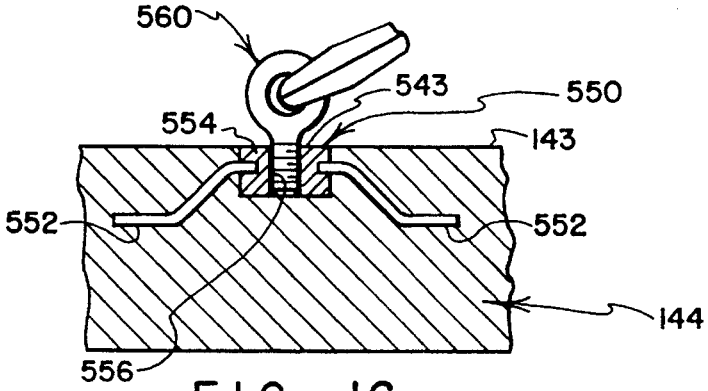

Referring to FIGS. 15 and 16, the lift connector 550 includes four dog-legged anchor formations 552 that extend into the cast refractory material of the segment 144 from a centrally located hub 554 that has a threaded passage 556 extending therethrough. An outer surface 543 of the hub 554 is positioned to extend flush with the front surface 143 of the segment 144—and the threaded passage 556 opens through the outer surface 543 so that an eyebolt 560 can be removably treaded into the passage 556.

Figure 14:
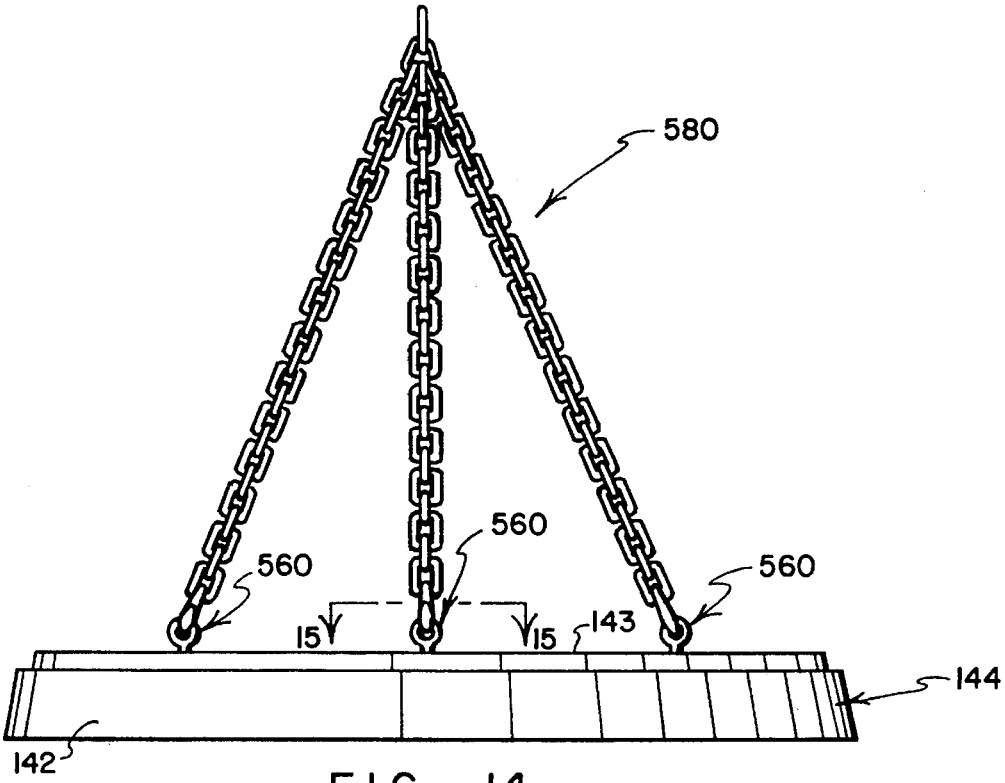
FIG. 14 is a side elevational view depicting a crane-connected, triumvirate type lifting fixture supporting a typical one of the cast refractory segments in a horizontally extending attitude, as during segment positioning and installation.

Three of the lift connectors 550 are incorporated into each of the cast refractory segments 144, 154, 155 at spaced locations—as is indicated in FIG. 2 by the numerals 550. A triumvirate type sling 580, as depicted in FIG. 14, can be connected to three eyebolts 560 that are threaded into the three lift connectors 550 of each of the segments 144, 154, 155 to move the segments 144, 154, 155 one at a time from place to place, and to final-position the segments 144, 154, 155 at a furnace site, while holding each of the segments 144, 154, 155 in a horizontal attitude. By this arrangement, there is no need to wrap chains or cables about the segments 144, 154, 155 to lift and move the segments 144, 154, 155; nor is there a need to try to balance the segments 144, 154, 155 on the forks of a lift truck or the like—which can cause unwanted chipping, cracking and other forms of segment damage and deterioration.

Referring to FIGS. 12 and 13, to hold the lift connectors 550 in place within the mold 500 during casting of the segment 144, three bolts 570 are threaded through holes formed in the front structure 502 and into the threaded passages 556 of three of the lift connectors 550. Once the molding of the segment 144 has been completed, the bolts 570 are removed so that the newly cast segment 144 does not remain securely bolted to the front structure 502. And, in the same general manner that has just been described, others of the segments 144, 154, 155 are mold-formed from castable refractory material, and are provided with anchored-in-place lift connectors 550.

The cast refractory outer segments 154, 155 have an added complication that needs to be taken into account when they are molded. As is best seen in FIG. 1, the welded steel structures 160 that are provided to extend along outer peripheral surfaces of the outer segments 154, 155 have wire-like anchor formations 161 that project into the cast refractory material of the segments 154, 155—in much the same manner that the doglegged anchor formations 552 of the lift connectors 550 extend into the cast refractory material of the inner segments 144. To form the outer segments, the steel structures 160 must be positioned by appropriately configured molds (not shown) to extend along peripheral segment surfaces that will be formed by the molds, with the anchor formations 161 positioned to project into the cavities of the molds so as to be surrounded by and embedded within the castable refractory material as the segments 154, 155 are molded. Because the positioning of steel structures in molds, with anchor formations extending from the steel structures into mold cavities to be embedded within castable refractory materials is well known to those who are skilled in the art, there is no need to further describe or illustrate molds or the molding techniques that are utilized in forming the segments 154, 155.

An advantage that derives from securely anchoring the steel structures 160 to the segments 154, 155 is that the cast refractory material of the segments 154, 155 serves to rigidly maintain the positions and configurations of the steel structures 160 during the temperature cycles that are encountered during operation of the furnace 100. By this arrangement, tendencies of the steel structures 160 to warp and break are, to a desirable degree, held in check by the presence of the cast refractory material of the segments 154, 155 that is securely connected to the steel structures 160.

Referring to FIGS. 6–8, the inner seal 200 preferably is formed as a serial array of generally cube shaped fiber refractory blocks 210, 212, interspersed among which are a plurality of thin pieces of perforated metal 220, 222 (preferably stainless steel), with the array of fiber blocks 210, 212 and metal members 220, 222 being underlaid by a narrow, elongate blanket 230 of fiber refractory material that is installed in bottom portions of the inner seal trough 110, and being overlaid by a narrow, elongate blanket 240 of fiber refractory material that is installed in upper portions of the inner seal trough 110.

Referring to FIG. 3, the blocks 210, 212 of fiber refractory material preferably are cut from an elongate log or bar 214 of fiber refractory material that is preferably is selected to have a width that will extend the full distance between the inner and outer surfaces 142, 152 at the widest dimension of the trough 110 that is to be occupied by the fiber blocks 210, 212, and a height that preferably is approximately equal to the width.

In preferred practice, the upper portion of the inner seal trough 110 that is to be occupied by the blocks 210, 212 measures six inches in width; the log or bar 214 of fiber refractory material from which the blocks 210, 212 are cut has width and height dimensions of six inches; a plurality of identical blocks 210, 212 measuring six inches by six inches by six inches are cut from the log or bar 214; and the bottom region of the trough 110 into which the blocks 210, 212 are to extend has a width of about five inches—so that, as the blocks 210, 212 are pressed down into the trough 110, bottom regions of the blocks 210, 212 are wedged and compressed a bit to ensure a snug fit in the trough 110.

Because the log or bar 214 of fiber refractory material from which the fiber blocks 210, 212 are cut typically is formed from elongate fibers of refractory material that are blow-formed to fabricate the log 214 in such a way that it tends to have fluffy "layers" of fiber (indicated generally by the numeral 216 in FIGS. 3–7) with a very perceptible direction of fiber orientation (indicated generally by arrows 218, 219 in FIGS. 3 and 4), care needs to be taken in selecting the manner in which the fiber blocks 210, 212 are oriented for insertion into the trough 110. After the blocks 210, 212 are cut from the log or bar 214, each of the blocks 210, 212 preferably is re-oriented by turning it in a right-angle manner that is indicated by an arrow 219 in FIGS. 3 and 4 before the re-oriented blocks 210, 212 are positioned side by side in the manner that is indicated in FIG. 4 to form the array that ultimately is inserted into the inner seal trough 110 to form the heart of the inner seal 200. By this arrangement, when the array of fiber blocks 210, 212 and metal members 220, 222 is installed in the trough 110, the "planes" 216 of fibers of the blocks 210, 212 will extend generally radially relative to the inner structure 140, not circumferentially with respect to the trough 110.

Referring to FIGS. 4 and 5, in preferred practice, approximately six adjacent ones of the re-oriented fiber blocks 210 are selected to form a fiber seal module 250 that can be put in place in the trough 110 as a unit. An assembled module 250 is depicted in FIG. 5. Portions of components included in the module 250 are depicted in FIG. 4. As will be apparent from comparing the fiber blocks 210 as they are depicted in FIGS. 4 and 5, when the module 250 is assembled, the fiber blocks 210 preferably are compressed to tightly sandwich such thin expanded metal members 220 as are interspersed among the fiber blocks 210 of the module.

In this document, the word "interspersed" is utilized in a normal way to designate placement of the metal members 220, 222 "at intervals in and/or among" the fiber blocks 210—which includes the preferred way of arranging the metal members 220, 222, namely between adjacent ones of the blocks 210, and also allows for the possibility that metal members 220 also could be inserted among the layers of fibers 216 within the blocks 210, 212. In preferred practice, seven thin metal members 220, 222 are utilized together with six fiber blocks 210 to form a module 250, with five of the metal members 220 each being sandwiched between separate adjacent pairs of the six fiber blocks 210, and with the remaining two metal members 222 serving end caps for the module 250.

To hold the module 250 together, two thin stainless steel rods 260 preferably are inserted through the six fiber blocks 210 and through the seven metal members 220, 222; washers 262 are installed on opposite ends of the rods 260; and ends of the rods 260 are welded to the washers 262 at locations that will hold the fiber blocks 210 and metal members 220, 222 of the module 250 in a suitably compressed form. Suitable module compression preferably is achieved by causing the end cap metal members 222 to be pressed toward each other to the extent that is needed to uniformly compress each of the fiber blocks 210 of the module to about two thirds of its normal length. In preferred practice, if each of the fiber blocks 210 measures six by six by six inches in size, compression of the blocks 210 during formation of a module 250 serves to reduce each of the blocks 210 to about six by six by four inches, with the resulting six-block module 250 having an overall length of about twenty four inches.

In preferred practice, a plurality of modules 250 of the type just described are utilized in forming the inner seal 200. Between each assembled module 250, a single fiber block 212 preferably is installed as a "spacer;" and, each of these "spacer" blocks 212 preferably is compressed to about two thirds of its normal length during the installation of the modules 250 and spacer blocks 212. If, when the installation of an inner seal 200 is about to be completed, it is found that room does not remain within the inner seal trough 110 to insert yet another full module 250 (but too much room remains in the trough 110 to be filled by only one of the compressed spacer blocks 212), more than one of the spacer blocks 212 can be installed in compressed form between selected adjacent pairs of the modules 250—so that not more than two or three of the compressed spacer blocks 212 will need to be installed between any of the adjacent pairs of modules 250.

Because the modules 250 tend to be straight (linear in nature) when formed, but need to be installed in an inner seal trough 110 that is curved, each of the modules 250 can be slightly bent, as is depicted in FIG. 6, prior to being installed. The thin diameter of the stainless steel rods 260 that extend through each of the modules 250 permits this, and the positioning of the two rods 260 of each module 250 one atop the other ensures that the presence of the rods 260 does not severely hinder efforts to deflect the shape of the modules 250 to conform to the curvature of the inner seal trough 110.

Figure 9:
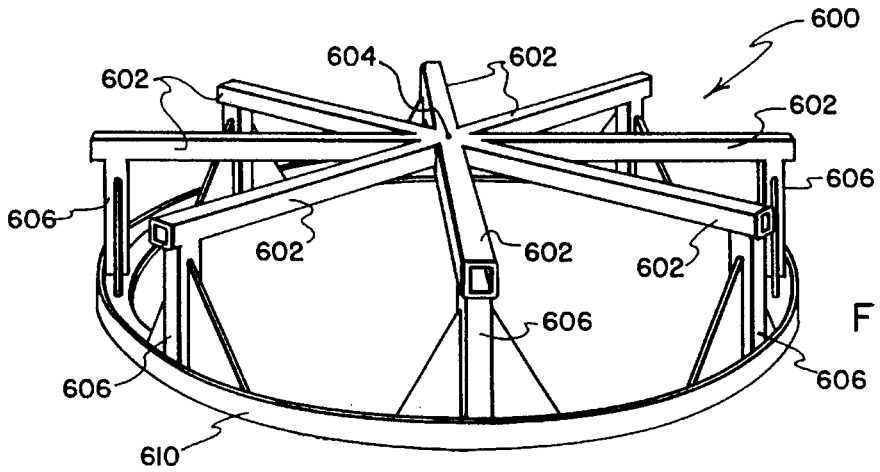
FIG. 9 is a perspective view of a special tool that, in accordance with preferred practice, is utilized in the assembly, maintenance, repair and rebuilding of trough-installed fiber seals that embody features of the present invention.
Figure 10:
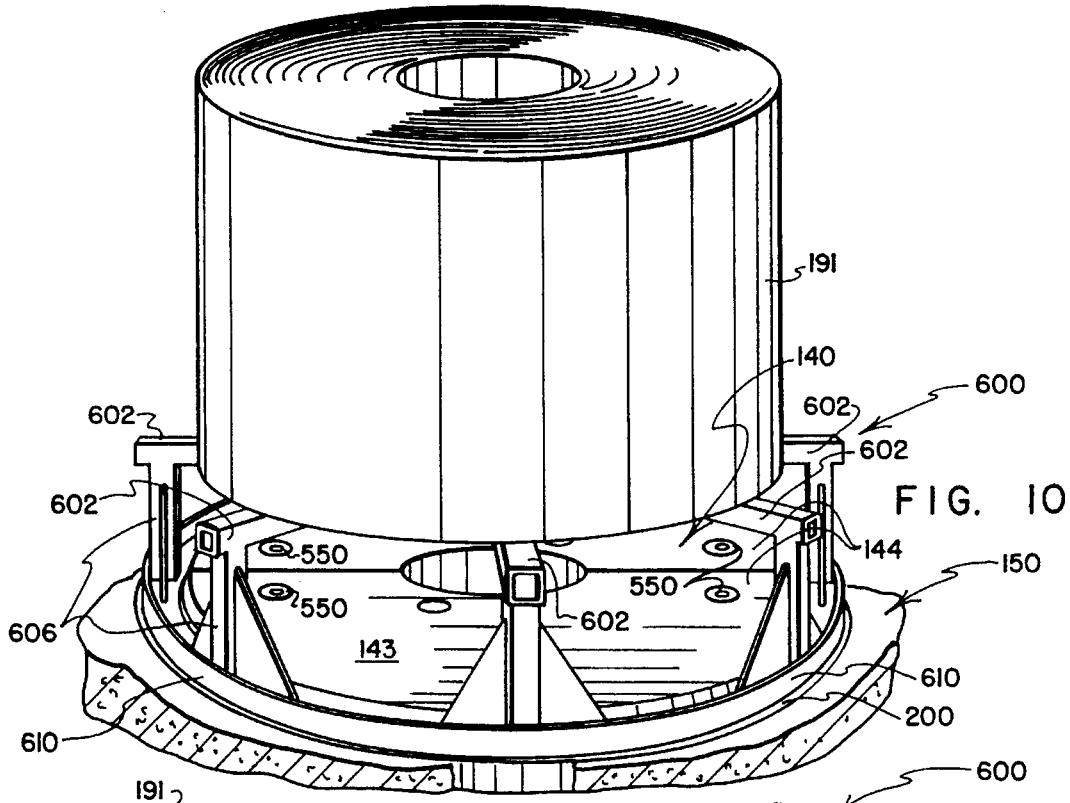
FIG. 10 is a perspective view showing the tool of FIG. 9 seated in engagement with a trough-carried inner seal, and having a heavy object, namely a coil of steel, resting atop the tool to provided needed weight.

While the modules 250 and spacer blocks 212 normally can be installed one at a time in the inner seal trough 110, by hand, with good success, pressing the modules 250, spacer blocks 212 and blankets 230, 240 into position to final-form an inner seal 200 preferably is carried out with the aid of a special tool 600 that is depicted in FIG. 9. Referring to FIG. 9, the tool 600 is a "compression fixture" that has a set of spoke-like bars 602 that connect at the center 604 of the tool 600, and that support depending uprights 606 that connect with a compression ring 610. The compression ring 610 has a flat bottom surface that is slightly more narrow than the width of the inner seal trough 110. The compression ring 610 is sized to be positionable atop a newly installed inner seal 200, as is illustrated in FIGS. 10 and 11, and is sufficiently strong to permit a heavy object, such as a coil of steel 191, to be seated atop the spoke-like bars 602 so that the weight of the coil 191 can be transferred to the compression ring 610 for pressing downwardly against the inner seal 200 to flatten and shape the top surface of the inner seal 200, and to ensure that all components of the inner seal 200 are seated and positioned within the inner seal trough 110.

The compression tool or fixture 600 also preferably is utilized periodically between operational cycles of the furnace 100 to again press and shape the inner seal 200—which tends to have something of a rejuvenation effect to restore life to and maintain the life of the inner seal 200. Likewise, if one or more components of the inner seal 200 (for example the upper blanket 240) has been repositioned or replaced, the compression fixture 600 preferably is utilized to press and reform the seal 200 before the seal 200 is again put into service.

The refractory fiber insulation that is used to form the underlying blankets 136, 230, the overlying blanket 240, and the fiber blocks 210, 212 should comprise a man-made refractory ceramic fiber product that is characterized by substantially uniform consistency, by a melting point of no less than about 3200 degrees Fahrenheit, and that is capable of rendering lengthy service without encountering significant deterioration while being cycled through a range of temperatures ranging from ambient temperature to about 1500 degrees Fahrenheit (and while being maintained at relatively high temperatures such as 1500 degrees Fahrenheit). Such products are available commercially from a variety of sources, for example from Thermal Ceramics, Inc. of Augusta, Ga. 30903 sold under trademarks KAOWOOL and PYRO-LOG R, or from Carborundum Company, Fibers Division, Niagara Falls, N.Y. 14302 under the trademark DURA-BLANKET S. Such materials are available in blanket form and in log form, as needed to form the blanket-like members 136, 230 and 240 and the fiber blocks 210, 212, respectively.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. While orientation terms as "upwardly," "downwardly," "leftwardly," "rightwardly" and the like have been utilized in describing the invention, these terms should not be interpreted as being limiting. It is intended that the patent shall cover, by suitable expression in the appended claims, whatever features of patentable novelty exist in the invention disclosed.

What is claimed is:

1. A set of components that are assemblable atop a base support structure of a single-stack annealing furnace to provide a rigid ceramic refractory base for extending in substantially concentric, annular relationship about a centrally located blower mount of the furnace, for underlying and extending perimetrically about charge support structure of the furnace that is of generally circular shape and that is configured to overlie the blower mount to centrally support a charge of metal that is to be annealed, and for defining a concentrically extending, relatively resilient annular inner seal that extends perimetrically about the charge support structure, atop which an inner enclosure of the furnace can be removably supported for defining a controlled environment treatment chamber within which a charge of metal that is positioned atop the charge support structure can be confined for treatment during an annealing process, comprising:

a) inner cast ceramic refractory segment means for defining an annular inner portion of the rigid ceramic refractory base for extending substantially concentrically about a blower mount of a single-stack annealing furnace, for underlying and supporting a generally circular charge support structure of the furnace, and for defining a substantially continuous, radially outwardly facing surface that extends substantially concentrically with respect to the circular charge support structure near the periphery thereof;

b) outer cast ceramic refractory segment means for defining an annular outer portion of the rigid ceramic refractory base for extending substantially concentrically about said annular inner portion, and for defining a substantially continuous, radially inwardly facing surface that extends substantially concentrically with respect to said radially outwardly facing surface so as to cooperate with said radially outwardly facing surface to define opposite, radially spaced sides of an inner seal positioning trough that extends circumferentially about the circular charge support structure;

c) inner seal means for being positioned in said inner seal positioning trough atop the base support structure of the furnace for defining an inner seal that extends in a substantially uninterrupted manner about said periphery of the circular charge support structure, that is capable of supporting the weight of an open-bottom inner enclosure of the furnace when bottom rim portions of the inner enclosure are seated atop the inner seal, and that is sufficiently resilient to cooperate with said seated bottom rim portions to form a gas impervious seal between the inner segment means and the inner enclosure;

d) wherein the inner seal means includes a plurality of ceramic fiber blocks for being arranged serially in a circumferentially extending, endless array within the confines of said inner seal positioning trough, with the array also including a plurality of relatively thin, perforated metal members for being interspersed among the ceramic fiber blocks to extend substantially radially at circumferentially spaced intervals within the confines of said trough, with said blocks having radially extending widths that are sufficient to extend substantially the full radially-measured distance between said radially outwardly facing surface and said radially outwardly facing surface at such locations within said trough as are to be occupied by said blocks, and with said blocks being sufficient in number and in size to require that said blocks be compressed in directions extending circumferentially with respect to said trough in order for all of said blocks to be inserted serially into said trough to form said array.

2. The set of components for a single-stack annealing furnace of claim 1 defining in assembled relation a base for an annealing furnace.

3. The set of components of claim 1 wherein the inner segment means includes a plurality of generally arcuate-shaped cast refractory inner segments that are configured to be positioned side by side to cooperatively define said annular inner portion of the rigid ceramic refractory base, and to cooperatively define said radially outwardly facing surface.

4. The set of components for a single-stack annealing furnace of claim 3 defining in assembled relation a base for an annealing furnace.

5. The set of components of claim 3 wherein all of the generally arcuate-shaped inner segments that comprise the inner segment means are of substantially identical configuration and are therefore interchangeable one with another.

6. The set of components for a single-stack annealing furnace of claim 5 defining in assembled relation a base for an annealing furnace.

7. The set of components of claim 1 wherein the inner segment means includes a pair of substantially identically configured, half-circle shaped inner segments.

8. The set of components for a single-stack annealing furnace of claim 7 defining in assembled relation a base for an annealing furnace.

9. The set of components of claim 1 wherein the inner segment means includes a plurality of inner segments that are positionable side by side to define said radially outwardly facing surface as having a truncated conical form that is inclined with respect to said radially inwardly facing surface so as to narrow the width of bottom portions of said inner seal positioning trough so that, as said inner seal means is compressed within said trough by the seating of the inner enclosure of the furnace atop said inner seal means, said inner seal means will continue to extend substantially the full radially measured distance between said radially outwardly facing surface and said radially outwardly facing surface.

10. The set of components for a single-stack annealing furnace of claim 9 defining in assembled relation a base for an annealing furnace.

11. The set of components of claim 1 wherein the inner segment means and the outer segment means are configured such that at least a selected one of said radially outwardly facing surface and said radially outwardly facing surface is of a truncated conical form that serves to narrow the width of bottom portions of said inner seal positioning trough so that, as said inner seal means is compressed within said trough by the seating of the inner enclosure of the furnace atop said inner seal means, said inner seal means will continue to extend substantially the full radially measured distance between said radially outwardly facing surface and said radially outwardly facing surface.

12. The set of components for a single-stack annealing furnace of claim 11 defining in assembled relation a base for an annealing furnace.

13. The set of components of claim 1 wherein the inner segment means and the outer segment means are configured such that the inner seal positioning trough that is defined therebetween maintains a substantially uniform cross-sectional configuration as it extends circumferentially about the charge support structure of the furnace, with the cross-sectional configuration being tapered such that said inner seal positioning trough narrows toward its bottom region and widens thereabove.

14. The set of components for a single-stack annealing furnace of claim 13 defining in assembled relation a base for an annealing furnace.

15. The set of components of claim 1 wherein said inner seal means also includes a relatively thin lower blanket of ceramic fiber refractory material that is installed in said inner seal positioning trough to underlie said array.

16. The set of components for a single-stack annealing furnace of claim 15 defining in assembled relation a base for an annealing furnace.

17. The set of components of claim 1 wherein said inner seal means also includes a relatively thin upper blanket of ceramic fiber refractory material that is installed in said inner seal positioning trough to overlie said array.

18. The set of components for a single-stack annealing furnace of claim 17 defining in assembled relation a base for an annealing furnace.

19. The set of components of claim 1 wherein the outer segment means includes a plurality of generally arcuate-shaped cast refractory outer segments that are configured to be positioned side by side to cooperatively define said outer portion of the rigid ceramic base, and to cooperatively define said radially inwardly facing surface.

20. The set of components for a single-stack annealing furnace of claim 19 defining in assembled relation a base for an annealing furnace.

21. The set of components of claim 19 wherein all of the generally arcuate-shaped outer segments that comprise the outer segment means are of substantially identical configuration and are therefore interchangeable one with another.

22. The set of components for a single-stack annealing furnace of claim 21 defining in assembled relation a base for an annealing furnace.

23. The set of components of claim 1 wherein the outer segment means includes four of substantially identically configured, quarter-circle shaped outer segments.

24. The set of components for a single-stack annealing furnace of claim 23 defining in assembled relation a base for an annealing furnace.

25. The set of components of claim 1 wherein the outer segment means includes a plurality of outer segments that are positionable side by side to define said radially inwardly facing surface as having a truncated conical form that is inclined with respect to said radially inwardly facing surface so as to narrow the width of bottom portions of said inner seal positioning trough so that, as said inner seal means is compressed within said trough by the seating of the inner enclosure of the furnace atop said inner seal means, said inner seal means will continue to extend substantially the full radially measured distance between said radially outwardly facing surface and said radially outwardly facing surface.

26. The set of components for a single-stack annealing furnace of claim 25 defining in assembled relation a base for an annealing furnace.

27. The set of components of claim 1 wherein the outer segment means includes formation means for defining an outer seal trough that extends substantially concentrically about said inner seal trough but at a location spaced radially outwardly with respect thereto.

28. The set of components for a single-stack annealing furnace of claim 27 defining in assembled relation a base for an annealing furnace.

29. The set of components of claim 1 wherein the outer segment means includes a plurality of outer components that are configured such that they may be positioned side by side to cooperatively define an outer seal trough that extends substantially concentrically about said inner seal trough but at a location spaced radially outwardly with respect thereto.

30. The set of components for a single-stack annealing furnace of claim 29 defining in assembled relation a base for an annealing furnace.

31. The set of components of claim 1 wherein the cast refractory outer segment means includes steel structure means that is partially embedded within the cast refractory material that is mold-formed to fabricate the cast refractory outer segment means, for defining an outer seal trough that extends substantially concentrically about said inner seal trough but at a location spaced radially outwardly with respect thereto.

32. The set of components for a single-stack annealing furnace of claim 31 defining in assembled relation a base for an annealing furnace.

33. The set of components of claim 1 wherein the cast refractory outer segment means includes a plurality of cast refractory outer segments that each have steel structure means that is partially embedded within the cast refractory material that is mold-formed to fabricate the cast refractory outer segments, for defining connection formations that can be rigidly connected by means of threaded fasteners.

34. The set of components for a single-stack annealing furnace of claim 33 defining in assembled relation a base for an annealing furnace.

35. The set of components of claim 33 wherein the cast refractory outer segments and the steel structure means are configured such that, when the steel structure means are connected by means of threaded fasteners, the steel structure means cooperate to define an outer seal trough that extends substantially concentrically about said inner seal trough but at a location spaced radially outwardly with respect thereto.

36. The set of components for a single-stack annealing furnace of claim 35 defining in assembled relation a base for an annealing furnace.

37. The set of components of claim 1 wherein a selected set of adjacent ones of the ceramic fiber blocks of the inner seal means and such ones of the thin, perforated metal members as are interspersed among the selected set of fiber blocks are coupled together by connecting means for forming an elongate module that can be lifted and installed as a unit in said inner seal positioning trough.

38. The set of components for a single-stack annealing furnace of claim 37 defining in assembled relation a base for an annealing furnace.

39. The set of components of claim 37 wherein the selected set of fiber blocks that is included in the elongate module includes two fiber blocks that are end blocks located at opposite ends of the elongate module, and at least one central fiber block that is located between the two end blocks, and the connecting means includes at least one thin, elongate member that extends substantially centrally through the elongate module so as to extend through not only the end and central blocks but also through the perforated metal members that are included in the module.

40. The set of components for a single-stack annealing furnace of claim 39 defining in assembled relation a base for an annealing furnace.

41. The set of components of claim 39 wherein the at least one central fiber block includes at least four central fiber blocks arranged serially between the two end blocks, and the elongate member that extends substantially centrally through the module extends serially through all of the end and central blocks.

42. The set of components for a single-stack annealing furnace of claim 41 defining in assembled relation a base for an annealing furnace.

43. The set of components of claim 39 wherein the perforated metal members that are included in the module include two metal members that are end blocks located at extreme opposite ends of the elongate module, and at least two central metal members that each are interposed between a separate adjacent pair of the set of fiber blocks that is included in the module, and the elongate member that extends substantially centrally through the module has its opposite ends connected to said end members.

44. The set of components for a single-stack annealing furnace of claim 43 defining in assembled relation a base for an annealing furnace.

45. The set of components of claim 43 wherein the connecting means includes at least two thin, elongate metal members that extend in spaced, side by side relationship substantially centrally through the elongate module so as to extend through not only the end and central blocks but also through the perforated metal members that are included in the module, with opposite ends of each of the two metal members being connected to said end members.

46. The set of components for a single-stack annealing furnace of claim 45 defining in assembled relation a base for an annealing furnace.

47. The set of components of claim 45 wherein the set of fiber blocks that is included in the module are substantially uniformly compressed when the module is formed so that the length of the module as measured by the distance between the end members is less than it would be if the module were formed utilizing non-compressed fiber blocks.

48. The set of components for a single-stack annealing furnace of claim 47 defining in assembled relation a base for an annealing furnace.

49. The set of components of claim 47 wherein the substantially uniform compression of the set of fiber blocks causes each of the blocks of the set to have a length, when compressed to form the module, that is about two-thirds of its non-compressed length.

50. The set of components for a single-stack annealing furnace of claim 49 defining in assembled relation a base for an annealing furnace.

51. The set of components of claim 37 wherein the elongate module is substantially straight when it is formed, but is sufficiently bendable to enable it to be bent to an arcuate shape prior to being installed in said inner seal positioning trough, with the arcuate shape to which the module can be bent corresponding to the curvature of said inner seal positioning trough.

52. The set of components for a single-stack annealing furnace of claim 51 defining in assembled relation a base for an annealing furnace.

53. The set of components of claim 37 wherein the array of ceramic fiber blocks and thin, perforated metal members that is provided for insertion into said inner seal positioning trough includes a plurality of elongate modules that each include a separate set of adjacent ceramic fiber blocks and such perforated metal members as are interspersed thereamong.

54. The set of components for a single-stack annealing furnace of claim 53 defining in assembled relation a base for an annealing furnace.

55. The set of components of claim 53 wherein the array of ceramic fiber blocks and thin, perforated metal members that is provided for insertion into said inner seal positioning trough includes said plurality of elongate modules and a plurality of spacer fiber blocks, with a sufficient number of spacer blocks being included so that at least one compressed spacer block can be installed between each adjacent pair of the modules when the modules and the spacer blocks are installed in said inner seal positioning trough to form said inner seal means.

56. The set of components for a single-stack annealing furnace of claim 55 defining in assembled relation a base for an annealing furnace.

57. The set of components of claim 1 wherein each of the fiber blocks is comprised of elongate fibers of ceramic refractory material, with the fibers of each block being sufficiently aligned so as to define a readily perceptible direction of orientation that extends substantially parallel to said opposed end surfaces of the block, and each of the fiber blocks is installable in said inner seal positioning trough with its end surfaces extending substantially transversely with respect to the length of said trough, whereby the direction of orientation of the fibers of the installed fiber blocks extends generally in radially oriented planes, not circumferentially, with respect to said inner seal positioning trough.

58. The set of components for a single-stack annealing furnace of claim 57 defining in assembled relation a base for an annealing furnace.

59. The set of components of claim 57 wherein the inner seal means additionally includes elongate ceramic fiber refractory blanket means for being positioned in said inner seal positioning trough, including a lower blanket that has a width that is sufficient to substantially fill the radially measured width of said trough, and that is of sufficient length to extend substantially the full length along the circumference of said trough for being installed in said trough before the array of fiber blocks and metal members are installed in the trough to underlie said array once said array has been installed in said trough, with the fibers of the blanket being sufficiently aligned so as to define a readily perceptible direction of orientation that extends substantially parallel to the length of the blanket, whereby the direction of orientation of the fibers of the installed lower blanket extends generally circumferentially with respect to said inner seal positioning trough.

60. The set of components for a single-stack annealing furnace of claim 59 defining in assembled relation a base for an annealing furnace.

61. The set of components of claim 57 wherein the inner seal means additionally includes elongate ceramic fiber refractory blanket means for being positioned in said inner seal positioning trough, including an upper blanket that has a width that is sufficient to substantially fill the radially measured width of said trough, and that is of sufficient length to extend substantially the full length along the circumference of said trough for being installed in said trough after the array of fiber blocks and metal members are installed in the trough to overlie said array once said array has been installed in said trough, with the fibers of the blanket being sufficiently aligned so as to define a readily perceptible direction of orientation that extends substantially parallel to the length of the blanket, whereby the direction of orientation of the fibers of the installed lower blanket extends generally circumferentially with respect to said inner seal positioning trough.

62. The set of components for a single-stack annealing furnace of claim 61 defining in assembled relation a base for an annealing furnace.

63. The set of components of claim 1 wherein the inner seal means additionally includes elongate ceramic fiber refractory blanket means for being positioned in said inner seal positioning trough, including a lower blanket that has a width that is sufficient to substantially fill the radially measured width of said trough, and that is of sufficient length to extend substantially the full length along the circumference of said trough for being installed in said trough before the array of fiber blocks and metal members are installed in the trough to underlie said array once said array has been installed in said trough, with the fibers of the blanket being sufficiently aligned so as to define a readily perceptible direction of orientation that extends substantially parallel to the length of the blanket, whereby the direction of orientation of the fibers of the installed lower blanket extends generally circumferentially with respect to said inner seal positioning trough.

64. The set of components for a single-stack annealing furnace of claim 63 defining in assembled relation a base for an annealing furnace.

65. The set of components of claim 1 wherein the inner seal means additionally includes elongate ceramic fiber refractory blanket means for being positioned in said inner seal positioning trough, including an upper blanket that has a width that is sufficient to substantially fill the radially measured width of said trough, and that is of sufficient length to extend substantially the full length along the circumference of said trough for being installed in said trough after the array of fiber blocks and metal members are installed in the trough to overlie said array once said array has been installed in said trough, with the fibers of the blanket being sufficiently aligned so as to define a readily perceptible direction of orientation that extends substantially parallel to the length of the blanket, whereby the direction of orientation of the fibers of the installed lower blanket extends generally circumferentially with respect to said inner seal positioning trough.

66. The set of components for a single-stack annealing furnace of claim 65 defining in assembled relation a base for an annealing furnace.

67. The set of components of claim 1 wherein the ceramic fiber blocks that are provided for insertion into said inner seal positioning trough have a substantially uniform width that is at least substantially equal to the maximum width of such portions of said trough as are to be filled by said blocks, and said trough is of tapered cross section with a progressively diminishing width being encountered at progressively deeper trough depths, whereby, bottom portions of said blocks are caused to be increasingly width-wise compressed as said blocks are pressed more deeply into said trough by the weight of the inner enclosure of the furnace being seated atop said inner seal means.

68. The set of components for a single-stack annealing furnace of claim 67 defining in assembled relation a base for an annealing furnace.

69. The set of components of claim 67 wherein the perforated metal members that are provided for insertion into said inner seal positioning trough have a height that is less than the height of the ceramic fiber blocks that are provided for insertion into said inner seal positioning trough so that, when bottom portions of said perforated metal members and bottom portions of said ceramic fiber blocks are installed in said inner seal positioning trough in engagement with a bottom wall of said trough, said metal members do not extend as high in said trough as do said blocks, whereby said metal members do not reinforce such portions of said fiber blocks as extend into upper portions of said trough at locations extending above the height of said metal members.

70. The set of components for a single-stack annealing furnace of claim 69 defining in assembled relation a base for an annealing furnace.

71. The set of components of claim 69 wherein said members are sufficiently stiff, when inserted into said trough in said array, to sufficiently reinforce lower portions of said inner seal means to prevent said inner seal means from being crushed within said trough to a height that is less than the height of said metal members.

72. The set of components for a single-stack annealing furnace of claim 71 defining in assembled relation a base for an annealing furnace.

73. The set of components of claim 1 wherein said fiber blocks have a non-compressed shape that is substantially cubical, measuring approximately 6 inches by 6 inches by 6 inches; said metal members are formed from thin pieces of perforated metal that are of about 4 inches by 4 inches in size; the portion of said inner seal positioning trough that is to be filled by said array has a depth of about 6 inches, a width at its top of about 6 inches, and a width at its bottom of about 5 inches, said fiber blocks are installed so as to extend into the bottom area of said trough with bottom portions thereof being compressed during installation to accommodate the bottom area width of said trough, and said metal members also are installed so as to extend into the bottom area of said trough.

74. The set of components for a single-stack annealing furnace of claim 73 defining in assembled relation a base for an annealing furnace.

75. The set of components of claim 73 wherein said inner seal additionally includes ceramic fiber blanket means including a lower blanket of ceramic fiber refractory material having a height of about 1 inch and a width that is sufficient to fill the width of the bottom area of said trough, for being installed in the bottom area of said trough to underlie said array of fiber blocks and metal members.

76. The set of components for a single-stack annealing furnace of claim 75 defining in assembled relation a base for an annealing furnace.

77. The set of components of claim 75 wherein said ceramic fiber blanket means additionally includes an upper blanket of ceramic fiber refractory material having a height of about 1 inch and a width that is sufficient to fill an upper area width of said trough, for being installed in an upper area of said trough atop to overlie said array of fiber blocks and metal members.

78. The set of components for a single-stack annealing furnace of claim 77 defining in assembled relation a base for an annealing furnace.

79. The set of components of claim 1 wherein at least a selected one of said inner segment means and said outer segment means includes at least one cast refractory segment that has lift connection means anchored into the cast refractory material from which the segment is formed for defining three spaced lift attachment points to which connection can be made with a crane to permit the segment to be lifted and moved about, with each of the three spaced lift attachment points opening through a single outer surface of the segment that faces upwardly when the segment is installed as a component of said refractory base.

80. The set of components for a single-stack annealing furnace of claim 79 defining in assembled relation a base for an annealing furnace.

81. A set of fiber seal components for being installed in a generally annular-shaped, circumferentially extending, upwardly opening, seal positioning trough of an annealing furnace base for defining a substantially endless, continuous, circumferentially extending, upwardly-facing seal of somewhat resilient character that can be engaged by other furnace structure that is removably positioned atop the seal, comprising ceramic fiber block means including a plurality of ceramic fiber blocks for being arranged serially in a circumferentially extending, endless array within the confines of said seal positioning trough, with the array also including metal reinforcement means including a plurality of relatively thin, perforated metal members for being interspersed among the ceramic fiber blocks to extend substantially radially at circumferentially spaced intervals within the confines of said trough, with said blocks having radially extending widths that are sufficient to extend substantially the full radially-measured width of said trough at locations within said trough where said blocks are to be installed, and with said blocks being sufficient in number and in size to require that said blocks be compressed in directions extending circumferentially with respect to said trough in order for all of said blocks to be inserted serially into said trough to form said array.

82. A base for an annealing furnace having a generally annular-shaped, circumferentially extending, upwardly opening, seal positioning trough with a seal therein assembled from the components of claim 81.

83. The set of components of claim 81 additionally including blanket means for being positioned in said trough together with said array, including a relatively thin lower blanket of ceramic fiber refractory material for being installed in said trough to underlie said array.

84. A base for an annealing furnace having a generally annular-shaped, circumferentially extending, upwardly opening, seal positioning trough with a seal therein assembled from the components of claim 83.

85. The set of components of claim 81 additionally including blanket means for being positioned in said trough together with said array, including a relatively thin upper blanket of ceramic fiber refractory material for being installed in said trough to overlie said array.

86. A base for an annealing furnace having a generally annular-shaped, circumferentially extending, upwardly opening, seal positioning trough with a seal therein assembled from the components of claim 85.

87. The set of components of claim 81 wherein a selected set of said blocks and such ones of the thin, perforated metal members as are interspersed among the selected set of blocks are coupled together by connecting means for forming an elongate module that can be lifted and installed as a unit in said seal positioning trough.

88. A base for an annealing furnace having a generally annular-shaped, circumferentially extending, upwardly opening, seal positioning trough with a seal therein assembled from the components of claim 87.

89. The set of components of claim 87 wherein the selected set of fiber blocks that is included in the elongate module includes two fiber blocks that are end blocks located at opposite ends of the elongate module, and at least one central fiber block that is located between the two end blocks, and the connecting means includes at least one elongate connecting member that extends substantially centrally through the elongate module so as to extend through not only the end and central blocks but also through the perforated metal members that are included in the module.

90. A base for an annealing furnace having a generally annular-shaped, circumferentially extending, upwardly opening, seal positioning trough with a seal therein assembled from the components of claim 89.

91. The set of components of claim 89 wherein the at least one central fiber block includes at least four central fiber blocks arranged serially between the two end blocks, and the elongate connection member extends serially through all of the end and central blocks.

92. A base for an annealing furnace having a generally annular-shaped, circumferentially extending, upwardly opening, seal positioning trough with a seal therein assembled from the components of claim 91.

93. The set of components of claim 89 wherein the perforated metal members that are included in the module include two metal members that are end blocks located at extreme opposite ends of the elongate module, and at least two central metal members that each are interposed between a separate adjacent pair of the set of fiber blocks that is included in the module, and the elongate connection member that extends substantially centrally through the module has its opposite ends connected to said end members.

94. A base for an annealing furnace having a generally annular-shaped, circumferentially extending, upwardly opening, seal positioning trough with a seal therein assembled from the components of claim 93.

95. The set of components of claim 93 wherein the connecting means includes at least two elongate metal members that extend in spaced, side by side relationship substantially centrally through the elongate module so as to extend through not only the end and central blocks but also through the perforated metal members that are included in the module, with opposite ends of each of the two metal members being connected to said end members.

96. A base for an annealing furnace having a generally annular-shaped, circumferentially extending, upwardly opening, seal positioning trough with a seal therein assembled from the components of claim 95.

97. The set of components of claim 95 wherein the set of fiber blocks that is included in the module are substantially uniformly compressed when the module is formed so that the length of the module as measured by the distance between the end members is less than it would be if the module were formed utilizing non-compressed fiber blocks.

98. A base for an annealing furnace having a generally annular-shaped, circumferentially extending, upwardly opening, seal positioning trough with a seal therein assembled from the components of claim 97.

99. The set of components of claim 97 wherein the substantially uniform compression of the set of fiber blocks causes each of the blocks of the set to have a length, when compressed to form the module, that is about two-thirds of its non-compressed length.

100. A base for an annealing furnace having a generally annular-shaped, circumferentially extending, upwardly opening, seal positioning trough with a seal therein assembled from the components of claim 99.

101. The set of components of claim 81 wherein the elongate module is substantially straight when it is formed, but is sufficiently bendable to enable it to be bent to an arcuate shape prior to being installed in said trough, with the arcuate shape to which the module can be bent corresponding to the curvature of said trough.

102. A base for an annealing furnace having a generally annular-shaped, circumferentially extending, upwardly opening, seal positioning trough with a seal therein assembled from the components of claim 101.

103. The set of components of claim 81 wherein the array of ceramic fiber blocks and thin, perforated metal members that is provided for insertion into said trough includes a plurality of elongate modules that each include a separate set of adjacent ceramic fiber blocks and such perforated metal members as are interspersed thereamong.

104. A base for an annealing furnace having a generally annular-shaped, circumferentially extending, upwardly opening, seal positioning trough with a seal therein assembled from the components of claim 103.

105. The set of components of claim 103 wherein the array of ceramic fiber blocks and thin, perforated metal members that is provided for insertion into said trough includes said plurality of elongate modules and a plurality of spacer fiber blocks, with a sufficient number of spacer blocks being included so that at least one compressed spacer block can be installed between each adjacent pair of the modules when the modules and the spacer blocks are installed in said trough to form said seal means.

106. A base for an annealing furnace having a generally annular-shaped, circumferentially extending, upwardly opening, seal positioning trough with a seal therein assembled from the components of claim 105.

107. The set of components of claim 81 wherein each of the fiber blocks is comprised of elongate fibers of ceramic refractory material, with the fibers of each block being sufficiently aligned so as to define a readily perceptible direction of orientation that extends substantially parallel to said opposed end surfaces of the block, and each of the fiber blocks is installable in said seal positioning trough with its end surfaces extending substantially transversely with respect to the length of said trough, whereby the direction of orientation of the fibers of the installed fiber blocks extends generally in radially oriented planes, not circumferentially, with respect to said trough.

108. A base for an annealing furnace having a generally annular-shaped, circumferentially extending, upwardly opening, seal positioning trough with a seal therein assembled from the components of claim 107.

109. The set of components of claim 107 wherein the seal means additionally includes elongate ceramic fiber refractory blanket means for being positioned in said seal positioning trough, including a lower blanket that has a width that is sufficient to substantially fill the radially measured width of said trough, and that is of sufficient length to extend substantially the full length along the circumference of said trough for being installed in said trough before the array of fiber blocks and metal members are installed in the trough to underlie said array once said array has been installed in said trough, with the fibers of the blanket being sufficiently aligned so as to define a readily perceptible direction of orientation that extends substantially parallel to the length of the blanket, whereby the direction of orientation of the fibers of the installed lower blanket extends generally circumferentially with respect to said trough.

110. A base for an annealing furnace having a generally annular-shaped, circumferentially extending, upwardly opening, seal positioning trough with a seal therein assembled from the components of claim 109.

111. The set of components of claim 107 wherein the inner seal means additionally includes elongate ceramic fiber refractory blanket means for being positioned in said seal positioning trough, including an upper blanket that has a width that is sufficient to substantially fill the radially measured width of said trough, and that is of sufficient length to extend substantially the full length along the circumference of said trough for being installed in said trough after the array of fiber blocks and metal members are installed in the trough to overlie said array once said array has been installed in said trough, with the fibers of the blanket being sufficiently aligned so as to define a readily perceptible direction of orientation that extends substantially parallel to the length of the blanket, whereby the direction of orientation of the fibers of the installed lower blanket extends generally circumferentially with respect to said trough.

112. A base for an annealing furnace having a generally annular-shaped, circumferentially extending, upwardly opening, seal positioning trough with a seal therein assembled from the components of claim 111.

* * * * *